US010517346B2

(12) United States Patent
Suddaby

(10) Patent No.: US 10,517,346 B2
(45) **Date of Patent: *Dec. 31, 2019**

(54) HELMET WITH MULTIPLE PROTECTIVE ZONES

(71) Applicant: Loubert S. Suddaby, Orchard Park, NY (US)

(72) Inventor: Loubert S. Suddaby, Orchard Park, NY (US)

( * ) Notice: Subject to any disclaimer, the term of this patent is extended or adjusted under 35 U.S.C. 154(b) by 263 days.

This patent is subject to a terminal disclaimer.

(21) Appl. No.: 15/602,678

(22) Filed: May 23, 2017

(65) Prior Publication Data

US 2017/0251744 A1 Sep. 7, 2017

Related U.S. Application Data

(63) Continuation of application No. 13/841,076, filed on Mar. 15, 2013, now Pat. No. 9,795,178, which is a continuation-in-part of application No. 13/412,782, filed on Mar. 6, 2012, now abandoned.

(51) Int. Cl.

| | |
|---|---|
| ***A42B 3/12*** | (2006.01) |
| ***A42B 3/06*** | (2006.01) |
| ***A42B 3/32*** | (2006.01) |

(52) U.S. Cl.

CPC ..... *A42B 3/121* (2013.01); *A42B 3/064* (2013.01); *A42B 3/124* (2013.01); *A42B 3/326* (2013.01)

(58) Field of Classification Search

CPC ..... A42B 3/121; A42B 3/064; A42B 3/124; A42B 3/322; A42B 3/326

See application file for complete search history.

(56) References Cited

U.S. PATENT DOCUMENTS

| | | | |
|---|---|---|---|
| 2,194,903 | A | 3/1940 | Holstein |
| 2,861,272 | A | 11/1958 | Stuart et al. |
| 3,089,144 | A | 5/1963 | Cherup |
| 3,107,356 | A | 10/1963 | Pestronk et al. |
| 3,167,069 | A | 1/1965 | Lobelle |
| 3,600,714 | A | 8/1971 | Cade et al. |
| 3,616,463 | A | 11/1971 | Theodore et al. |
| 3,668,704 | A | 6/1972 | Conroy et al. |
| 3,872,511 | A | 3/1975 | Nichols |

(Continued)

FOREIGN PATENT DOCUMENTS

| | | |
|---|---|---|
| CN | 201094314 | 8/2008 |
| DE | 19544375 | 3/1997 |

(Continued)

*Primary Examiner* — Sally Haden

(74) *Attorney, Agent, or Firm* — Simpson & Simpson, PLLC

(57) ABSTRACT

A protective helmet, including a hard outer shell, a hard inner shell slidingly connected to, and spaced apart from, the outer shell, and a leaf spring including a center portion, a first end, and a second end, the leaf spring anchored only at the center portion onto the hard outer shell, the first end unattached to, and in sliding contact with the hard inner shell, and the second end unattached to, and in sliding contact with the hard inner shell. In a neutral position, the first end is spaced from the second end by a first distance, and when a force strikes the helmet, the first end is spaced from the second end by a second distance, the second distance being different from the first distance.

18 Claims, 23 Drawing Sheets

(56) References Cited

U.S. PATENT DOCUMENTS

| | | | | | |
|---|---|---|---|---|---|
| 3,875,275 | A | | 4/1975 | Lemelson | |
| 3,946,441 | A | | 3/1976 | Johnson | |
| 4,023,209 | A | | 5/1977 | Frieder, Jr. et al. | |
| 4,075,717 | A | | 2/1978 | Lemelson | |
| 4,307,471 | A | * | 12/1981 | Lovell | A42B 3/065 2/411 |
| 4,586,200 | A | | 5/1986 | Poon | |
| 4,903,346 | A | | 2/1990 | Reddemann et al. | |
| 5,101,517 | A | | 4/1992 | Douglas | |
| 5,181,279 | A | | 1/1993 | Ross | |
| 5,204,998 | A | * | 4/1993 | Liu | F16F 1/3732 2/411 |
| 5,263,202 | A | | 11/1993 | Siberell | |
| 5,319,808 | A | | 6/1994 | Bishop et al. | |
| 5,815,846 | A | | 10/1998 | Calonge | |
| 5,950,244 | A | | 9/1999 | Fournier et al. | |
| 5,956,777 | A | | 9/1999 | Ponovich | |
| 6,138,283 | A | | 10/2000 | Kress | |
| 6,604,246 | B1 | | 8/2003 | Obreja | |
| 6,658,671 | B1 | | 12/2003 | Von Holst et al. | |
| 6,817,039 | B1 | | 11/2004 | Grilliot et al. | |
| 8,176,574 | B2 | | 5/2012 | Bryant et al. | |
| 2008/0229488 | A1 | | 9/2008 | Kim | |
| 2010/0000009 | A1 | * | 1/2010 | Morgan | A42B 3/124 2/414 |
| 2012/0198604 | A1 | | 8/2012 | Weber et al. | |
| 2012/0233745 | A1 | | 9/2012 | Veazie | |
| 2012/0297526 | A1 | | 11/2012 | Leon | |
| 2013/0061371 | A1 | | 3/2013 | Phipps et al. | |
| 2014/0173810 | A1 | | 6/2014 | Suddaby | |

FOREIGN PATENT DOCUMENTS

| | | |
|---|---|---|
| EP | 0048442 | 3/1982 |
| JP | 2001295129 | 10/2001 |
| WO | WO 2010-151631 | 12/2010 |
| WO | 2011090381 | 7/2011 |

* cited by examiner

HELMET WITH MULTIPLE PROTECTIVE ZONES

This application is filed under 35 U.S.C. § 120 as a continuation patent application of U.S. patent application Ser. No. 13/841,076, filed Mar. 15, 2013, which application is a continuation-in-part patent application of U.S. patent application Ser. No. 13/412,782, filed Mar. 6, 2012, the contents of which are hereby incorporated herein by reference in their entirety.

FIELD

The present disclosure relates generally to protective headgear, more particularly to sports or workplace protective headgear, and still more particularly, to protective headgear designed to prevent or reduce head injury caused by linear or rotational forces.

BACKGROUND

The human brain is an exceedingly delicate structure protected by a series of envelopes to shield it from injury. The innermost layer, the pia mater, covers the surface of the brain. The human brain is an exceedingly delicate structure protected by a series of envelopes to protect it from injury. The innermost layer, the pia mater, covers the surface of the brain. The arachnoid layer, adjacent to the pia mater, is a spidery web-like membrane that acts like a waterproof membrane. Finally, the dura mater, a tough leather-like layer, covers the arachnoid layer and adheres to the bones of the skull.

While this structure protects against penetrating trauma, the softer inner layers absorb only a small amount of energy before linear forces applied to the head are transmitted to the brain. When an object strikes a human head, both the object and the human head are moving independently and often in different angles thus, angular forces, as well as linear forces, are almost always involved in head injuries. Many surgeons in the field believe the angular or rotational forces applied to the brain are more hazardous than direct linear forces due to the twisting or shear forces they apply to the white matter tracts and the brain stem.

One type of brain injury that occurs frequently is the mild traumatic brain injury (MTBI), more commonly known as a concussion. Such injury occurs in many settings, such as, construction worksites, manufacturing sites, and athletic endeavors and is particularly problematic in contact sports. While at one time a concussion was viewed as a trivial and reversible brain injury, it has become apparent that repetitive concussions, even without loss of consciousness, are serious deleterious events that contribute to debilitating irreversible diseases, such as dementia and neuro-degenerative diseases including Parkinson's disease, chronic traumatic encephalopathy (CTE), and dementia pugilistica.

U.S. Pat. No. 5,815,846 (Calonge) describes a helmet with fluid filled chambers that dissipate force by squeezing fluid into adjacent equalization pockets when external force is applied. In such a scenario, energy is dissipated only through viscous friction as fluid is restrictively transferred from one pocket to another. Energy dissipation in this scenario is inversely proportional to the size of the hole between the full pocket and the empty pocket. That is to say, the smaller the hole, the greater the energy drop. The problem with this design is that, as the size of the hole is decreased and the energy dissipation increases, the time to dissipate the energy also increases. Because fluid filled chambers react hydraulically, energy transfer is in essence instantaneous. Hence, in the Calonge design, substantial energy is transferred to the brain before viscous fluid can be displaced negating a large portion of the protective function provided by the fluid filled chambers. Viscous friction is too slow an energy dissipating modification to adequately mitigate concussive force. If one were to displace water from a squeeze bottle one can get an idea as to the function of time and force required to displace any fluid when the size of the exit hole is varied. The smaller the transit hole, the greater the force required and the longer the time required for any given force to displace fluid.

U.S. Pat. No. 6,658,671 (Hoist) describes a helmet with inner and outer shells and a sliding layer. The sliding layer allows for the displacement of the outer shell relative to the inner shell to help dissipate some of the angular force during a collision applied to the helmet. However, the force dissipation is confined to the outer shell of the helmet. In addition, the Holst helmet provides no mechanism for returning the two shells to the resting position relative to each other. A similar shortcoming is shown in the helmets described in U.S. Pat. No. 5,956,777 (Popovich) and European patent publication EP 0048442 (Kalman et al.).

German Patent DE 19544375 (Zhan) describes a construction helmet that includes apertures in the hard outer shell that allows the expansion of cushion material through the apertures to dispel some of the force of a collision. However, because the inner liner rests against a user's head, some force is directed toward rather than away from the head.

U.S. Patent Application Publication No. 2012/0198604 (Weber et al.) describes a safety helmet for protecting the human head against repetitive impacts as well as moderate and severe impacts to reduce the likelihood of brain injury caused by both translational and rotational forces. The helmet includes isolation dampers that act to separate an outer liner from an inner liner. Gaps are provided between the ends of the outer liner and the inner liner to provide space to enable the outer liner to move without contacting the inner liner upon impact.

Clearly, to prevent traumatic brain injury, not only must penetrating objects be stopped, but any force, angular or linear, imparted to the exterior of the helmet must also be prevented from simply being transmitted to the enclosed skull and brain. The helmet must not merely play a passive role in dampening such external forces, but must play an active role in dissipating both linear and angular momentum imparted such that they have little or no deleterious effect on the delicate brain.

To afford maximum protection from linear and angular forces, the outer shell of a helmet mitigating such force must be capable of movement independent from the inner shell of the helmet which covers and encloses the skull and brain, such that any force vector or vectors can be allayed prior to the force getting to the brain.

To attain these objectives in a helmet design, the inner component (shell) and the outer component (shell or shells) must be capable of appreciable degrees of movement independent of each other. Additionally, the momentum imparted to the outer shell should both be directed away from and/or around the underlying inner shell and brain and sufficiently dissipated or stored so as to negate deleterious effects.

Therefore, there is a need for a protective helmet that mitigates these deleterious consequences of repetitive traumatic brain injury.

SUMMARY

According to aspects illustrated herein, there is provided a protective helmet, comprising a hard outer shell, a hard inner shell slidingly connected to, and spaced apart from, the outer shell, and a leaf spring comprising a center portion, a first end, and a second end, the leaf spring anchored only at the center portion onto the hard outer shell, the first end unattached to, and in sliding contact with the hard inner shell, and the second end unattached to, and in sliding contact with the hard inner shell. In a neutral position, the first end is spaced from the second end by a first distance, and when a force strikes the helmet, the first end is spaced from the second end by a second distance, the second distance being different from the first distance.

According to aspects illustrated herein, there is provided a protective helmet, comprising a hard outer shell, a hard inner shell slidingly connected to, and spaced apart from, the hard outer shell, and a leaf spring comprising a center portion, the leaf spring anchored only at the center portion to the hard outer shell, a first end unattached to, and in direct sliding contact with, the hard inner shell, and a second end, unattached to, and in direct sliding contact with, the hard inner shell, wherein in a neutral position, the first end is spaced from the second end by a first distance, and when a force strikes the helmet, the first end is spaced from the second end by a second distance, the second distance being different from the first distance.

These and other objects, features, and advantages of the present disclosure will become readily apparent upon a review of the following detailed description of the disclosure, in view of the drawings and appended claims.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

Figure 1:
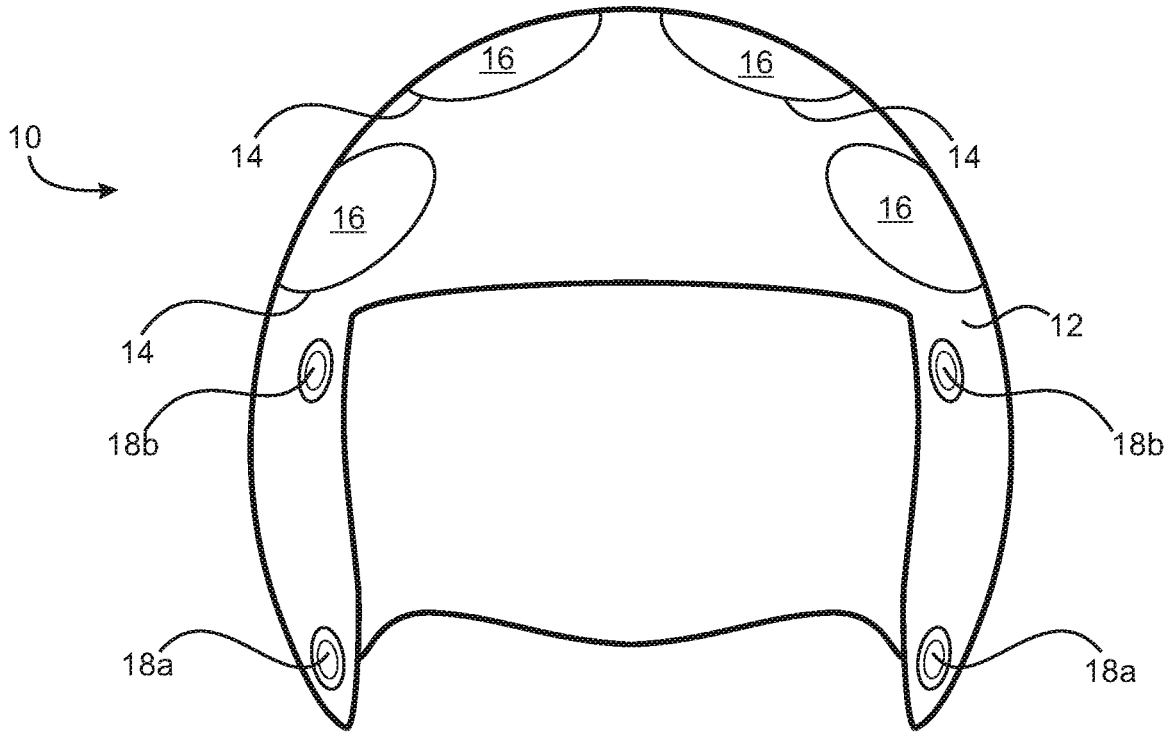
FIG. 1 is a front view of the double shell helmet ("helmet")

At the outset, it should be appreciated that like drawing numbers on different drawing views identify identical, or functionally similar, structural elements. It is to be understood that the claims are not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the claims.

Unless defined otherwise, all technical and scientific terms used herein have the same meaning as commonly understood to one of ordinary skill in the art to which this disclosure pertains. It should be understood that any methods, devices or materials similar or equivalent to those described herein can be used in the practice or testing of the example embodiments.

It should be appreciated that the term "substantially" is synonymous with terms such as "nearly," "very nearly," "about," "approximately," "around," "bordering on," "close to," "essentially," "in the neighborhood of," "in the vicinity of," etc., and such terms may be used interchangeably as appearing in the specification and claims. It should be appreciated that the term "proximate" is synonymous with terms such as "nearby," "close," "adjacent," "neighboring," "immediate," "adjoining," etc., and such terms may be used interchangeably as appearing in the specification and claims.

In one embodiment, the inner shell and outer shell are connected to each other by elastomeric cords that serve to limit the rotation of the outer shell on the inner shell and to dissipate energy by virtue of elastic deformation rather than passively transferring rotational force to the brain as with existing helmets. In effect, these elastomeric cords function like mini bungee cords that dissipate both angular and linear forces through a mechanism known as hysteretic damping, i.e., when elastomeric cords are deformed, internal friction causes high energy losses to occur. These elastomeric cords are of particular value in preventing so called contrecoup brain injury.

The outer shell, in turn, floats on the inner shell by virtue of one or more force absorbers or deflectors such as, for example, fluid-filled bladders, leaf springs, or sinusoidal springs, located between the inner shell and the outer shell. To maximize the instantaneous reduction or dissipation of a linear and/or angular force applied to the outer shell, the fluid-filled bladders interposed between the hard inner and outer shells may be intimately associated with, that is located under, one or more apertures in the outer shell with the apertures preferably being covered with elastomeric diaphragms and serving to dissipate energy by bulging outward against the elastomeric diaphragm whenever the outer shell is accelerated, by any force vector, toward the inner shell. Alternatively, the diaphragms could be located internally between inner and outer shells, or at the inferior border of the inner and outer shells, if it is imperative to preserve surface continuity in the outer shell. This iteration would necessitate separation between adjacent bladders to allow adequate movement of associated diaphragms.

In existing fluid-filled designs, when the outer shell of a helmet receives a linear force that accelerates it toward the inner shell, the interposed gas or fluid is compressed and displaced. Because gas and especially fluid is not readily compressible, it passes the force passively to the inner shell and hence to the skull and the brain. This is indeed the very mechanism by which existing fluid-filled helmets fail. The transfer of force is hydraulic and essentially instantaneous, negating the effectiveness of viscous fluid transfers as a means of dissipating concussive force.

Because of the elastomeric diaphragms in the present invention, any force imparted to the outer shell will transfer to the gas or liquid in the bladders, which, in turn, will instantaneously transfer the force to the external elastomeric diaphragms covering the apertures in the outer shell. The elastomeric diaphragms, in turn, will bulge out through the aperture in the outer shell, or at the inferior junction between inner and outer shells thereby dissipating the applied force through elastic deformation at the site of the diaphragm rather than passively transferring it to the padded lining of the inner shell. This process directs energy away from the brain and dissipates it via a combination of elastic deformation and tympanic resonance or oscillation. By oscillating, an elastic diaphragm employs the principle of hysteretic damping over and over, thereby maximizing the conversion of kinetic energy to low-level heat, which, in turn, is dissipated harmlessly to the surrounding air.

Furthermore, the elastomeric springs or cords that bridge the space holding the fluid-filled bladders (like the arachnoid membrane in the brain) serve to stabilize the spatial relationship of the inner and outer shells and provide additional dissipation of concussive force via the same principle of elastic deformation via the mechanism of stretching, torsion, and even compression of the elastic cords.

By combining the bridging effects of the elastic springs or cords as well as the elastomeric diaphragms strategically placed at external apertures, both linear and rotational forces can be effectively dissipated.

In an alternate embodiment, leaf springs may replace fluid-filled bladders as a force absorber/deflector. Leaf springs may be structured as a fully elliptical spring or, preferably, formed in a parabolic shape. In both forms, the leaf spring is anchored at a single point to either the outer shell or, preferably, the hard inner shell and extends into the zone between the outer shell and inner shell. The springs may have a single leaf (or arm) or comprise a plurality of arms arrayed radially around a common anchor point. Preferably, each arm tapers from a thicker center to thinner outer portions toward each end of the arm. Further, the ends of each arm may include a curve to allow the end to more easily slide on the shell opposite the anchoring shell. In contrast to the use of leaf springs in vehicles, the distal end of the spring arms are not attached to the non-anchoring or opposite shell. This allows the ends to slide on the shell to allow independent movement of each shell when the helmet is struck by rotational forces. This also enables the frictional dissipation of energy. Preferably, the distal ends contact the opposite shell in the neutral condition, that is, when the helmet is not in the process of being struck.

Figure 2:
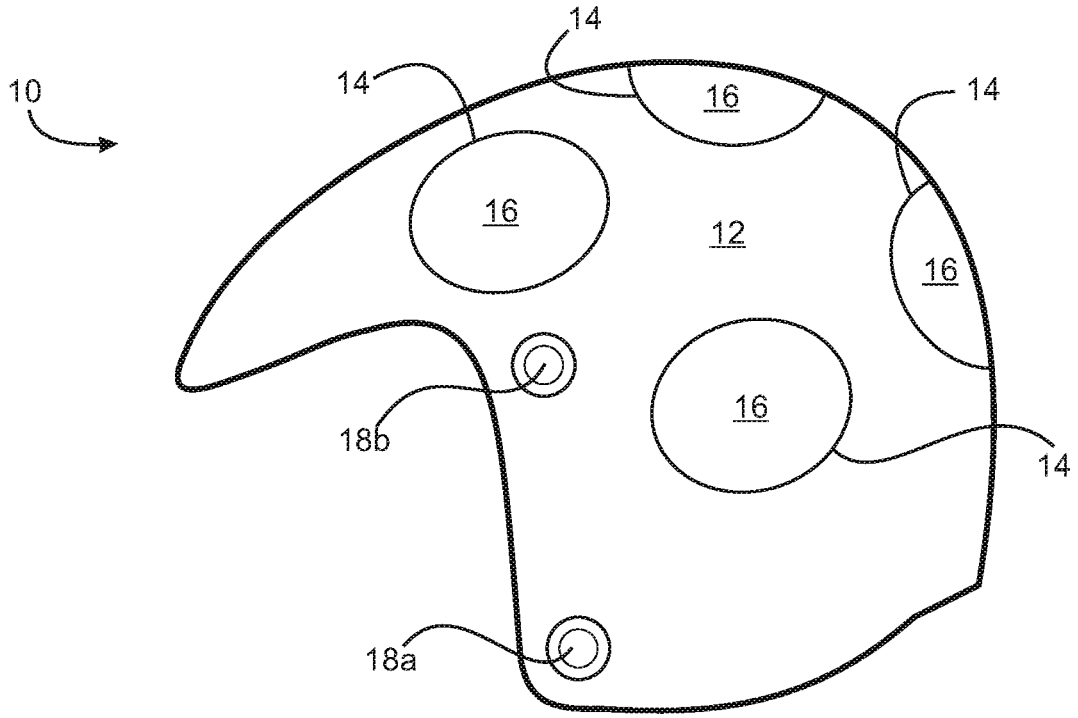
FIG. 2 is a side view of the helmet of FIG. 1 showing two face protection device attachments on one side of the helmet.

Adverting to the drawings, FIG. 1 is a front view of multiple protective zone helmet 10 ("helmet 10"). The outer protective zone is formed by outer shell 12 and is preferably manufactured from rigid, impact resistant materials such as metals, plastics, polycarbonates, ceramics, composites, and similar materials well known to those having skill in the art. Outer shell 12 defines at least one and preferably a plurality of apertures 14 (or aperture 14). Apertures 14 may be open but are preferably covered by a flexible elastomeric material in the form of diaphragms 16 (or diaphragm 16). In a preferred embodiment, helmet 10 also includes several face protection device attachments. FIG. 1 shows face protection device attachments 18*a* and 18*b*; however, helmet 10 can have any suitable number of face protection device attachments. In a more preferred embodiment, face protection device attachments are fabricated from a flexible elastomeric material to provide flexibility to the attachment. The elastomeric material reduces the rotational pull on helmet 10 if the attached face protection device (not shown in FIG. 1) is pulled. By "elastomeric" it is meant any of various substances resembling rubber in properties, such as resilience and flexibility. Such elastomeric materials are well known to those having skill in the art. FIG. 2 is a side view of helmet 10 showing two face protection device attachments 18*a* and 18*b* on one side of the helmet. Examples of face protection devices are visors and face masks. Such attachments can also be used for chin straps releasably attached to the helmet in a known manner.

Figure 3A:
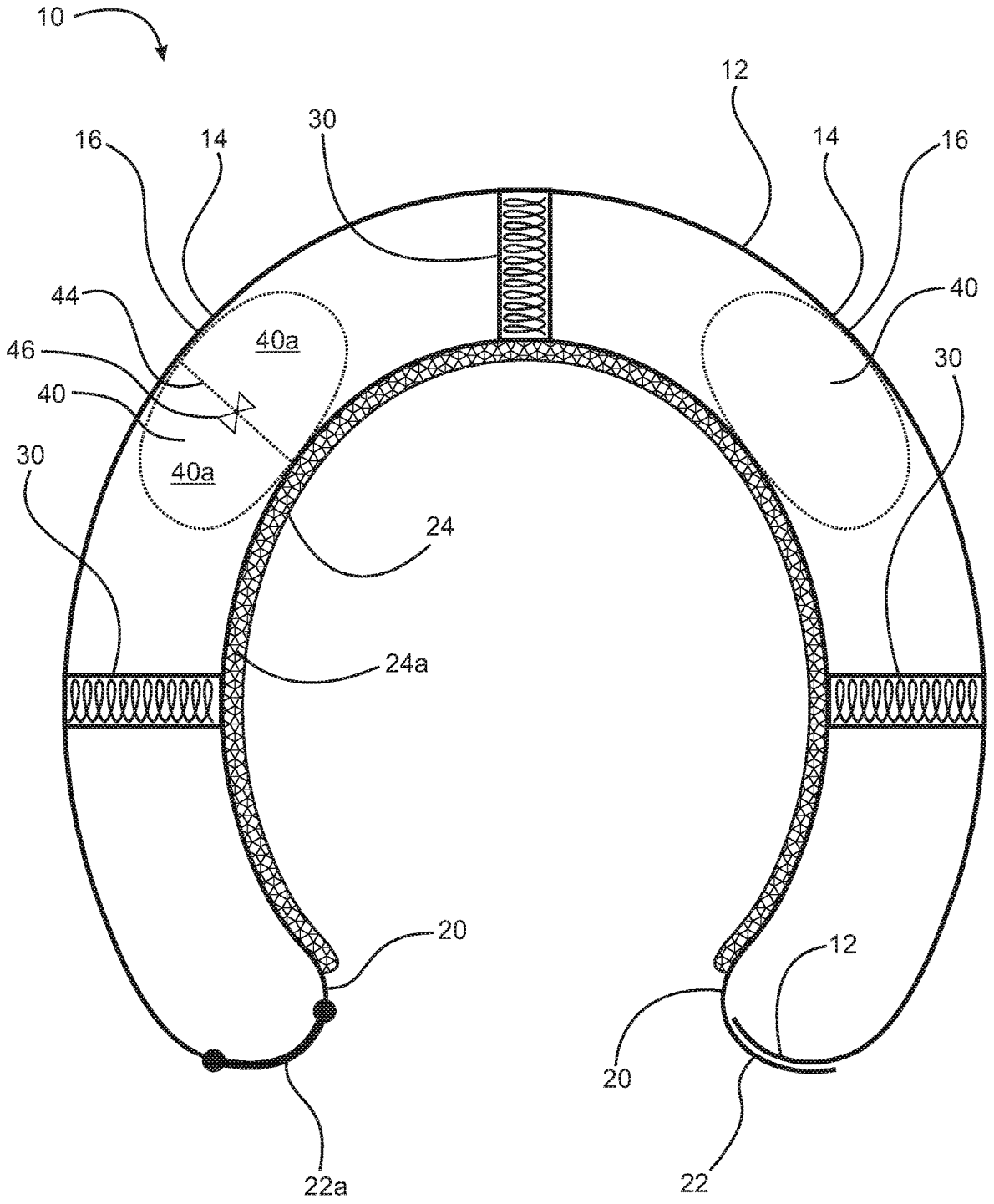
FIG. 3A is a cross-sectional view of the helmet of FIG. 1 showing an inner shell and elastomeric cords connecting the two shells.

FIG. 3A is a cross-sectional view of helmet 10 showing the hard inner shell 20 and the elastomeric springs or cords 30 (or cords 30) that extend through an elastomeric zone connecting the two shells. Inner shell 20 forms an anchor zone and is preferably manufactured from rigid, impact resistant materials such as metals, plastics such as polycarbonates, ceramics, composites, and similar materials well known to those having skill in the art. Inner shell 20 and outer shell 12 are slidingly connected at sliding connection 22. By "slidingly connected" it is meant that the edges of inner shell 20 and outer shell 12, respectively, slide against or over each other at connection 22. In an alternate embodiment, outer shell 12 and inner shell 20 are connected by an elastomeric element, for example, a u-shaped elastomeric connector 22*a* ("connector 22*a*"). Sliding connection 22 and connector 22*a* each serve to both dissipate energy and maintain the spatial relationship between outer shell 12 and inner shell 20.

Cords 30 are flexible cords, such as bungee cords or elastic "hold down" cords, or their equivalents, used, for example, to hold articles on car or bike carriers. This flexibility allows outer shell 12 to move or "float" relative to inner shell 20 while remaining connected to inner shell 20. This floating capability is also enabled by the sliding connection 22 between outer shell 12 and inner shell 20. In an alternate embodiment, sliding connection 22 may also include elastomeric connection 22*a* between outer shell 12 and inner shell 20. Padding 24 forms an inner zone and lines the inner surface of inner shell 20 to provide a comfortable material to support helmet 10 on the user's head. In one embodiment, padding 24 may enclose loose cushioning pieces 24*a* such as STYROFOAM® beads or "peanuts," or loose oatmeal.

Also shown in FIG. 3A is a cross-sectional view of bladders 40 (or bladder 40) situated in the elastomeric zone between outer shell 12 and inner shell 20. Helmet 10 includes at least one, but preferably a plurality of bladders 40. Bladders 40 are filled with fluid, either a liquid such as water, or a gas such as helium or air. In one preferred embodiment, the fluid is helium as it is light and its use would reduce the total weight of helmet 10. In an alternate embodiment, bladders 40 may also include compressible beads or pieces such as STYROFOAM® beads. Bladders 40 are preferably located under apertures 14 of outer shell 12 and are in contact with both inner shell 20 and outer shell 12. Thus, when outer shell 12 is pressed in toward inner shell 20 (and thus the user's skull) during a collision, bladder 40 is squeezed and the fluid therein is compressed, similar to squeezing a balloon. Bladder 40 will bulge toward aperture 14 and displace elastomeric diaphragm 16. This bulging-displacement action diverts the force of the blow from radially inward (i.e., toward the user's skull and brain) to radially outward (i.e., up toward the apertures) providing a new direction for the force vector. Bladders 40 may also be divided internally into compartments 40*a* by bladder wall 44 such that, if the integrity of one of compartments 40*a* is breached, another compartment will still function to dissipate linear and rotational forces. Bladders 40 may additionally comprise valve(s) 46 arranged between compartments 40*a* to control the fluid movement. In the example embodiment shown in FIG. 3A, bladders 40 include two compartments. It should be appreciated, however, that any number of compartments suitable to control the fluid movement can be used.

Figure 3B:
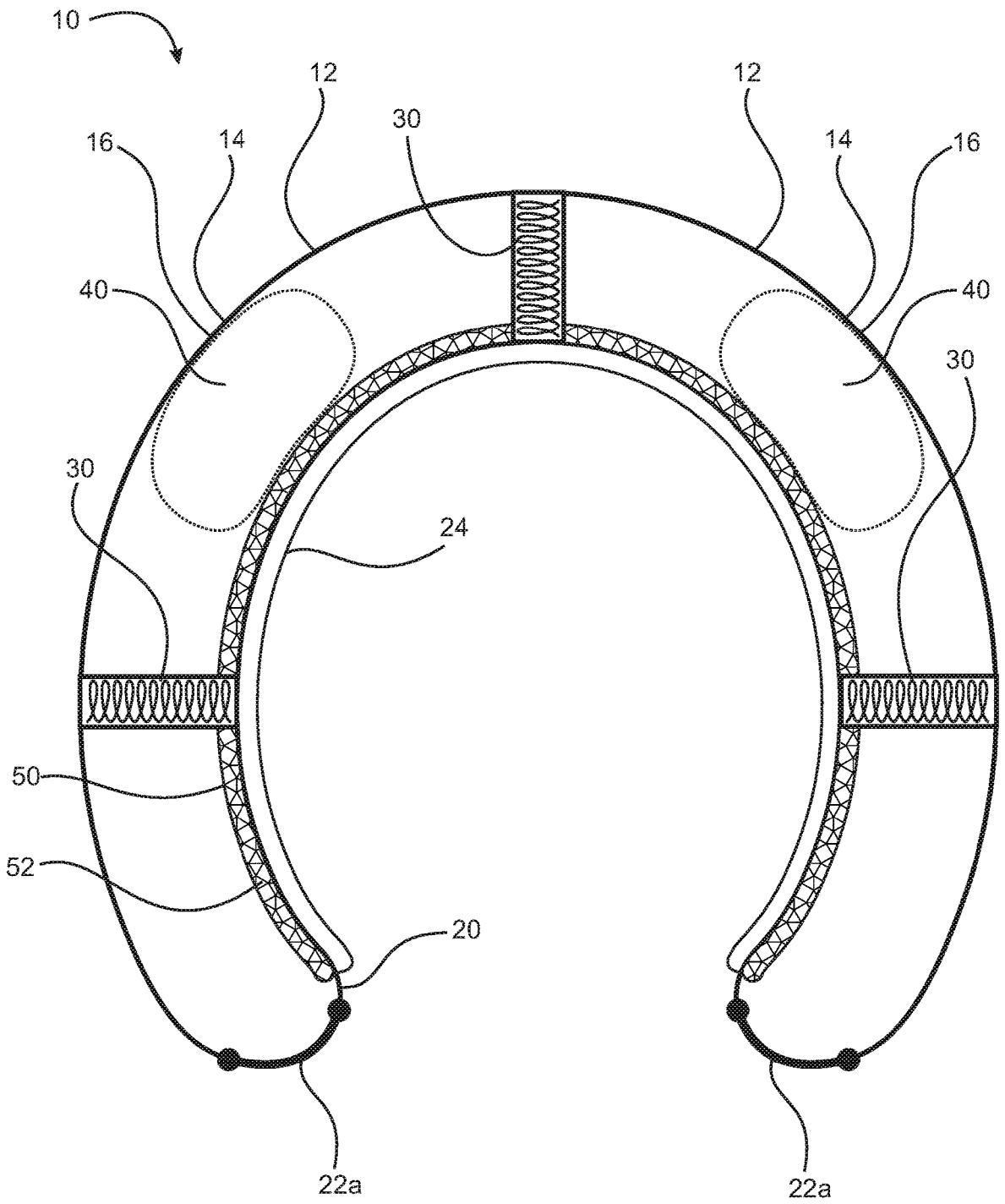
FIG. 3B is a cross-sectional view similar to FIG. 3 depicting an alternate embodiment of the helmet including an intermediate shell enclosing cushioning pieces.

FIG. 3B is a cross-sectional view, similar to FIG. 3A discussed above, depicting an alternate embodiment of helmet 10. Helmet 10 shown in FIG. 3B includes crumple zone or intermediate shell 50 located between outer shell 12 and inner shell 20. In the embodiment shown, intermediate shell 50 is close, or adjacent, to inner shell 20. Intermediate shell 50 encloses filler 52. Preferably, filler 52 is a compressible material that is packed to deflect the energy of a blow and protect the skull, similar to a "crumple zone" in an automobile. Filler 52 is designed to crumple or deform, thereby absorbing the force of the collision before it reaches inner pad 24 and the braincase. In this embodiment, cords 30 extend from inner shell 20 to outer shell 12 through intermediate shell 50. One suitable material for filler 52 is STYROFOAM® beads or "peanuts," or an equivalent material such as materials used for packing objects. Because of its "crumpling" function, intermediate shell 50 is preferably constructed with a softer or more deformable material than outer shell 12 and/or inner shell 20. Typical fabrication material for intermediate shell 50 is a stretchable material such as latex or spandex or other similar elastomeric fabric that preferably encloses filler 52.

Figure 3C:
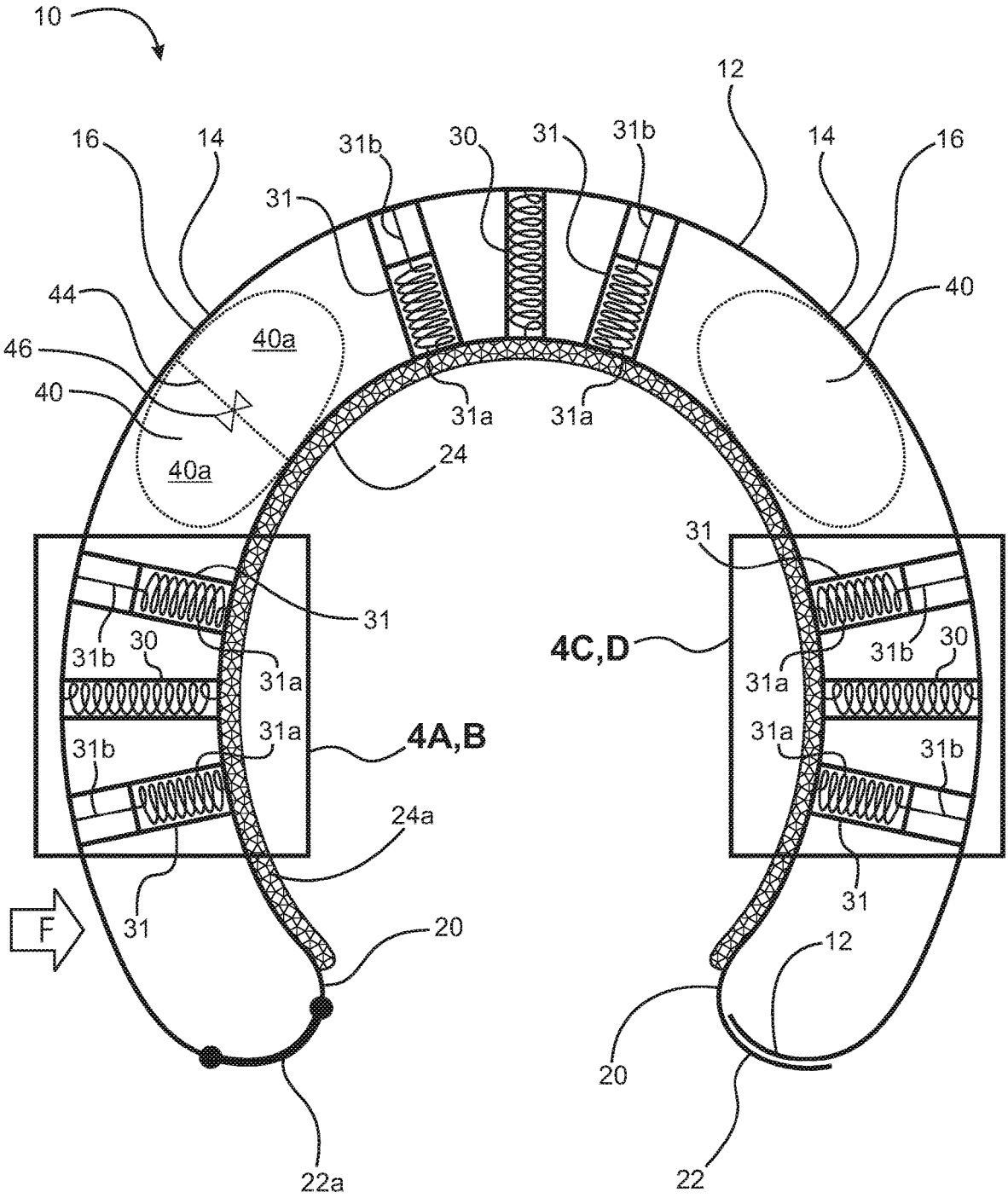
FIG. 3C is a cross-sectional view similar to FIG. 3A depicting an alternate embodiment of the elastomeric cords in which some of the elastomeric cords have thin and thick portions.

FIG. 3C is a cross-sectional view similar to FIG. 3A depicting an alternate embodiment of helmet 10 comprising elastomeric cords 30 and 31. Elastomeric cords 31 (or cord 31) include thick elastomeric portions 31*a* and thin nonelastomeric portions 31*b*. In the embodiment shown, thick elastomeric portions 31*a* are connected to the outer surface of inner shell 20, but alternatively may be connected to the inner surface of outer shell 12. Thin nonelastomeric portions 31*b* of cords 31 are connected to the inner surface of outer shell 12, but alternatively may be attached to the outer surface of inner shell 20. Thin nonelastomeric portions 31*b* may comprise a single cord or multiple cords. In this exemplary embodiment, thick elastomeric portions 31*a* of cords 31 are thicker than uniform elastomeric cords 30. For example, the diameter of elastomeric portions 31*a* is greater than the diameter of cords 30. It should be appreciated, however, that elastomeric portions 31*a* and cords 30 may have any suitable diameter that allows cords 31 to act as a backup to prevent cords 30 from being stretched beyond their elastic limit. Also shown in FIG. 3C is force F located to the left of helmet 10. Force F is directed radially inward relative to helmet 10 and represents a blow to outer shell 12 as will be discussed with respect to FIGS. 4A-D.

Figure 4A:
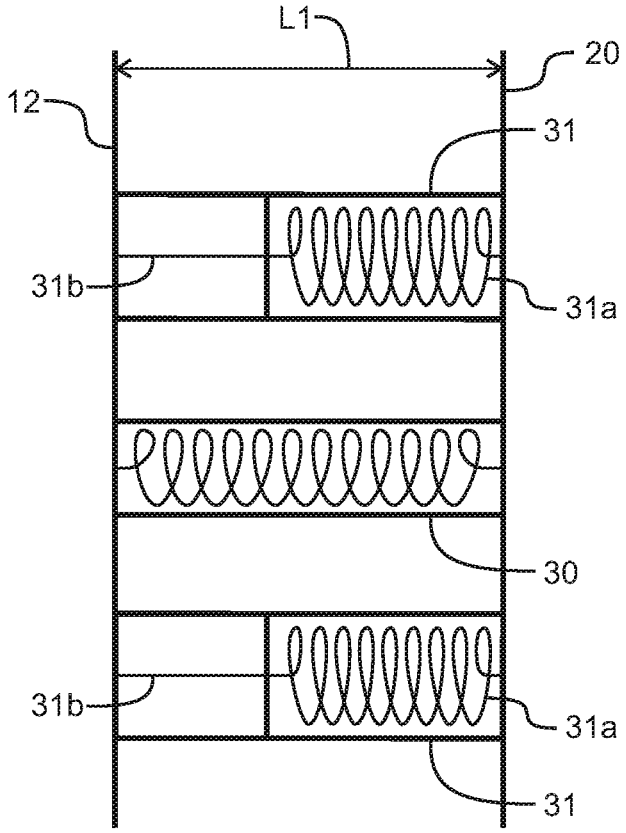
FIG. 4A is an enlarged schematic view of the cords shown in FIG. 3C in a neutral position.
Figure 4B:
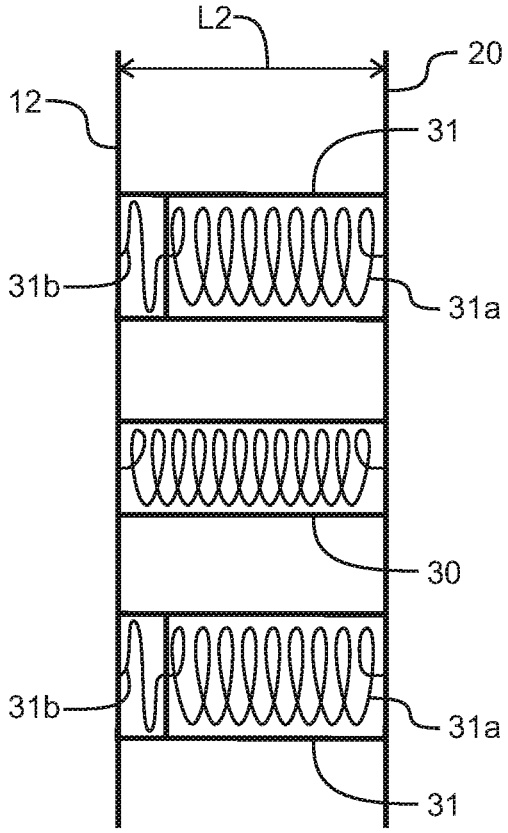
FIG. 4B is an enlarged schematic view of the cords shown in FIG. 3C in compression.
Figure 4C:
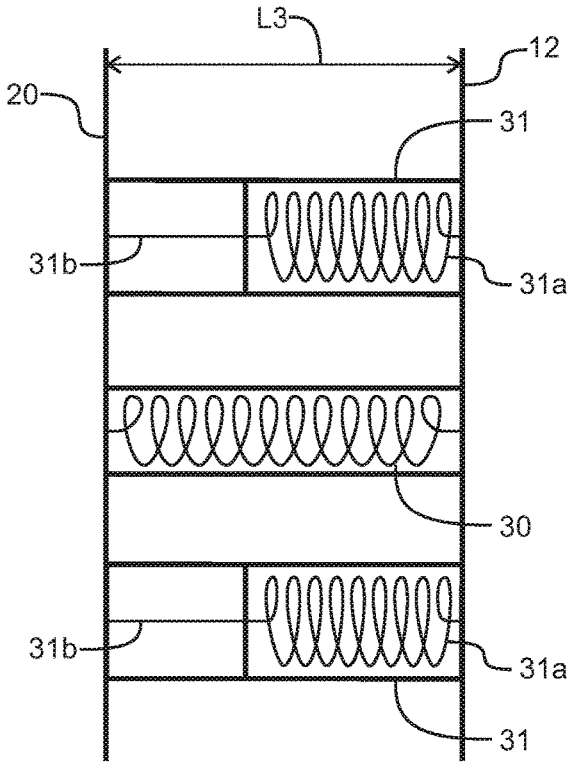
FIG. 4C is an enlarged schematic view of the cords shown in FIG. 3C in a neutral position.
Figure 4D:
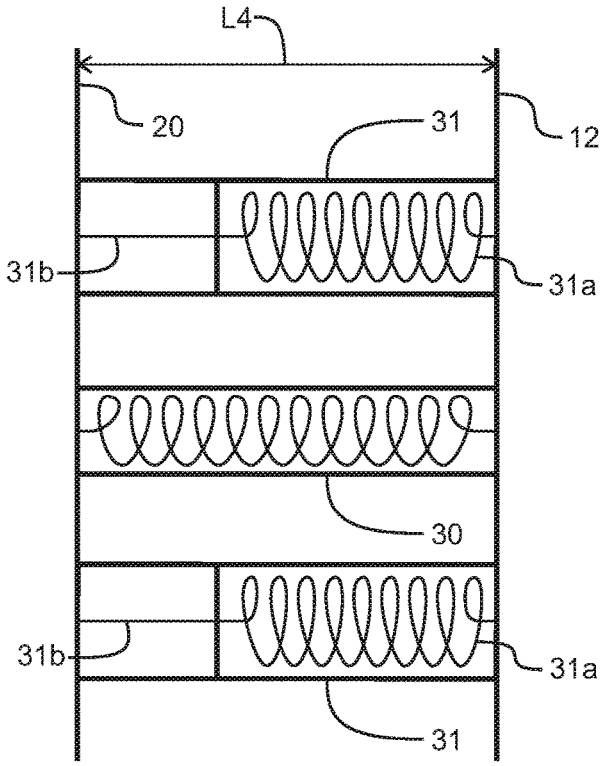
FIG. 4D is an enlarged schematic view of the cords shown in FIG. 3C in tension.

FIGS. 4A-D are enlarged schematic views of cords 30 and 31 as shown in FIG. 3C. FIGS. 4A and 4B are enlarged views of detail 4A,B in FIG. 3C. FIG. 4A shows cords 30, which have uniform thickness throughout their lengths, and cords 31 in the neutral position. In the neutral position, cords 30 are under slight tension while cords 31 are under no tension. In the neutral position, the distance between inner shell 20 and outer shell 12 and thus the length of cords 30 and 31 is length L1. FIG. 4B shows cords 30 and 31 as shown in FIG. 4A, but under maximum compression as a result of force F impacting helmet 10 (as directed in FIG. 3C). When force F, a greater than normal force, is applied, outer shell 12 displaces radially inward relative to inner shell 20 (i.e., the radially distance between inner shell 20 and outer shell 12 decreases). In this case, significant compression occurs in elastomeric cord 30; however, only nominal compression occurs in cord 31. As shown, nonelastomeric portions 31*b* loosens and elastomeric portions 31*a* exhibits only nominal or no compression. In the compressed state, the distance between inner shell 20 and outer shell 12 and thus the length of cords 30 and 31 is length L2, which is less than length L1. FIGS. 4C and 4D are enlarged views of detail 4C,D in FIG. 3C. FIG. 4C shows cords 30, which have uniform thickness throughout their lengths, and cords 31 in the neutral position. In the neutral position, cords 30 are under slight tension while cords 31 are under no tension. In the neutral position, the distance between inner shell 20 and outer shell 12 and thus the length of cords 30 and 31 is length L3, which is substantially equal to L1. FIG. 4D shows cords 30 and 31 as shown in FIG. 4C, but under maximum tension as a result of force F impacting helmet 10 (as directed in FIG. 3C). When force F is applied, outer shell 12 displaces radially outward relative to inner shell 20 (i.e., the radial distance between inner shell 20 and outer shell 12 increases). In this case, significant expansion occurs in elastomeric cord 30, and moderate expansion occurs in cord 31. As shown, nonelastomeric portions 31*b* are tightly drawn and elastomeric portions 31*a* are moderately expanded. Under maximal displacement of outer shell 12 relative to inner shell 20, cords 30 may be stretched close or up to their elastic limit. However, when this occurs, nonelastomeric portion 31*b* of cord 31 engages elastomeric portion 31*a* to mitigate the large force striking helmet 10 and to prevent any loss of elasticity in cord 30. By using cord 31 as a backup for blows struck with severe force, greater protection can be achieved even after cord 30 reaches its elastic limit and does not interfere with absorbing any rotational forces striking helmet 10. For this reason, cords 31 preserve the integrity of the cord system of helmet 10. In the expanded state, the distance between inner shell 20 and outer shell 12 and thus the length of cords 30 and 31 is length L4, which is greater than length L1.

Figure 5A:
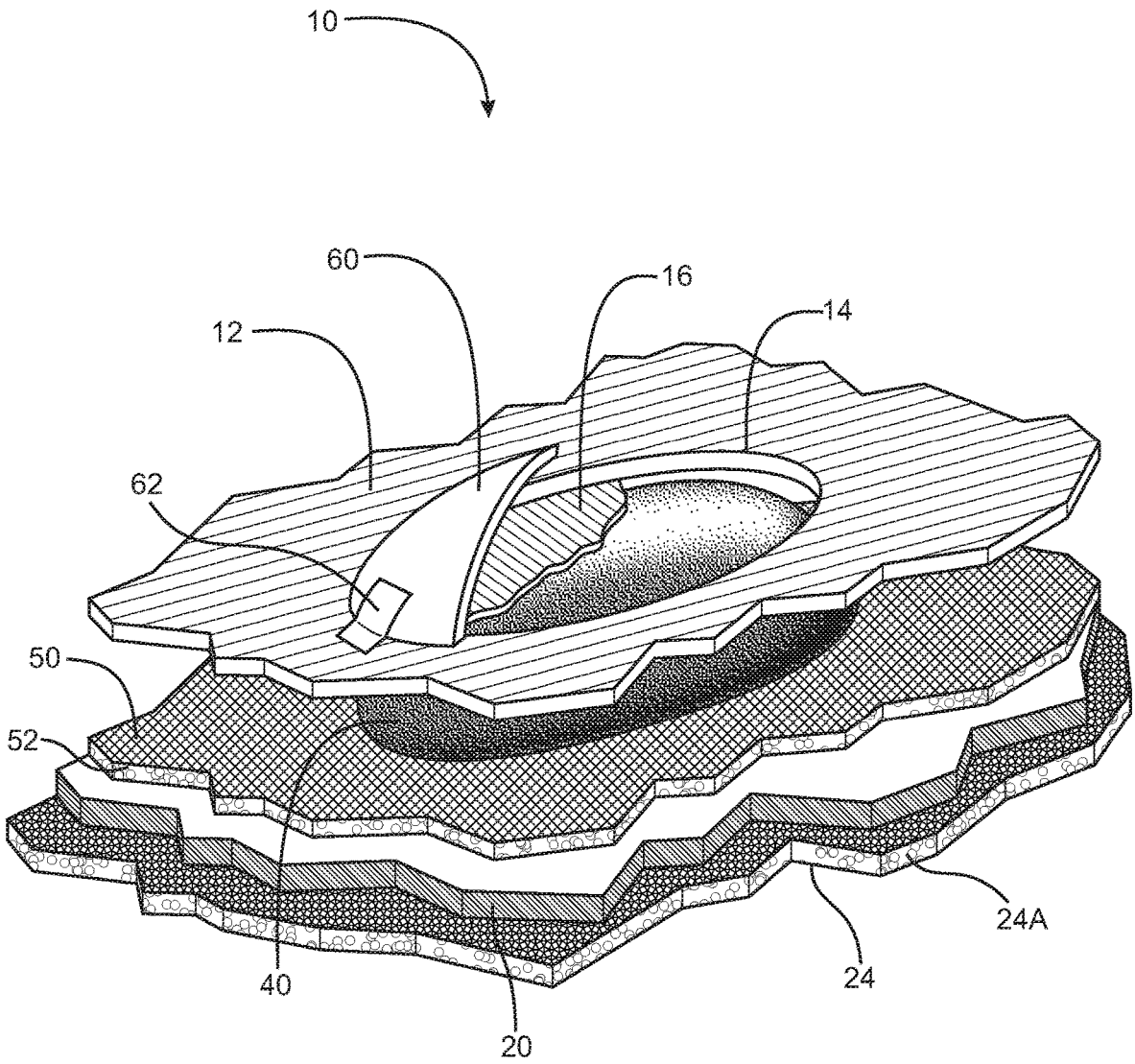
FIG. 5A is a top perspective view of a section of the outer shell of the helmet showing an alternate embodiment including a liftable lid that protect diaphragms covering apertures in the outer shell of the helmet.
Figure 5B:
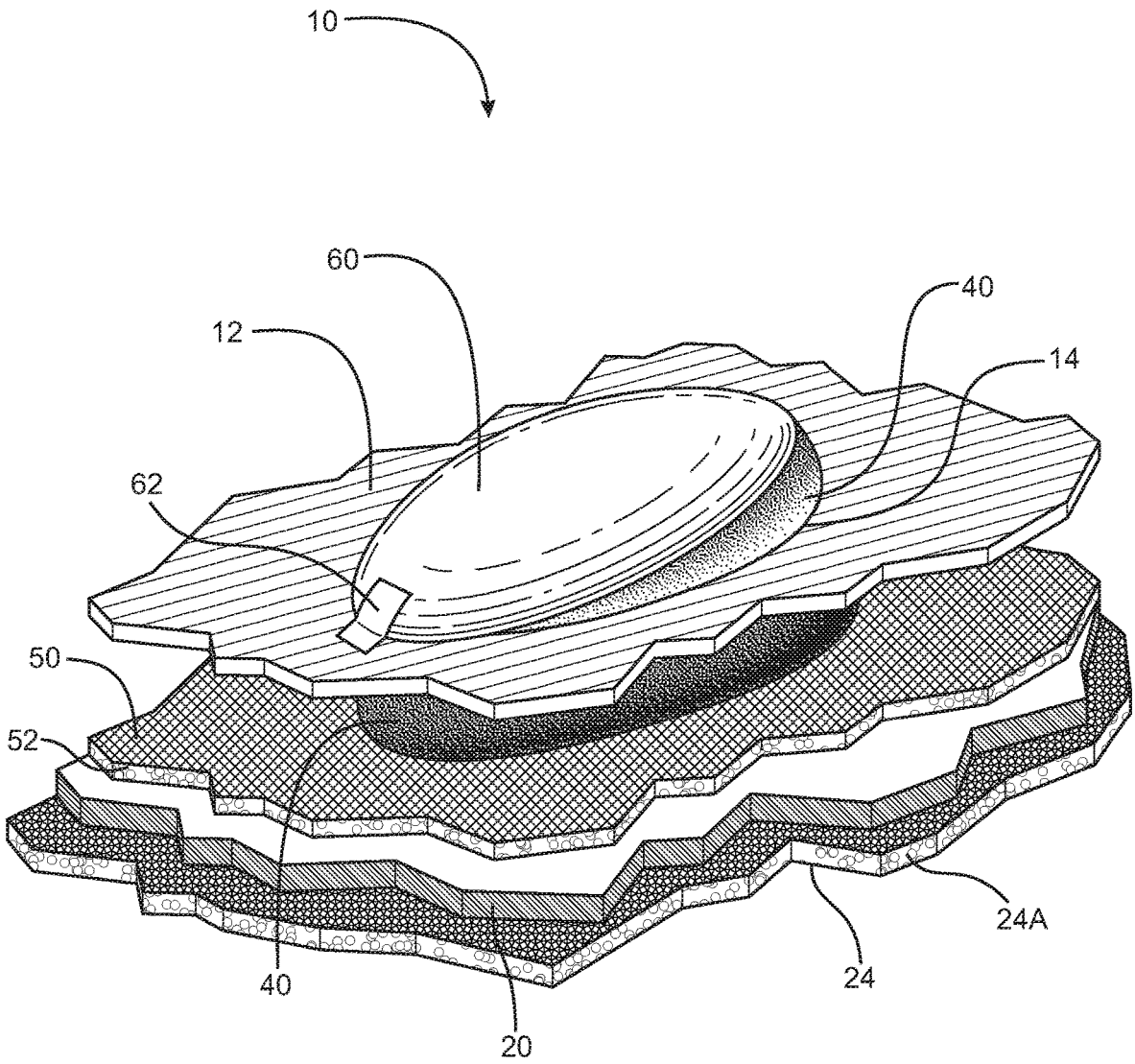
FIG. 5B is a top perspective view of a section of the outer shell of the helmet, as shown in FIG. 5A, depicting the liftable lid protecting the bulging fluid-filled bladder.

FIG. 5A is a top view of one section of outer shell 12 of helmet 10 showing an alternate embodiment in which liftable lids 60 (or lid 60) are used to cover aperture 14 to shield diaphragm 16 and/or bladder 40 from punctures, rips, or similar incidents that may destroy their integrity. Lids 60 are attached to outer shell 12 by lid connectors 62 (or connector 62). Lids 60 are operatively arranged to lift or raise up if a particular diaphragm 16 bulges outside of aperture 14 due to the expansion of one or more bladders 40. Because it is liftable, lid 60 allows diaphragm 16 to freely elastically bulge through aperture 14 above the surface of outer shell 12 (i.e., radially outward from outer shell 12) to absorb and redirect the force of a collision, and also protects diaphragm 16 from damage due to external forces. In an alternate embodiment, diaphragm 16 is not used and lid 60 directly shields and protects bladder 40. In an example embodiment, connectors 62 are hinges. In an example embodiment, connectors 62 are flexible plastic attachments. FIG. 5B depicts liftable lid 60 protecting bladder 40 as it bulges through aperture 14 and radially outward from outer shell 12.

Figure 6A:
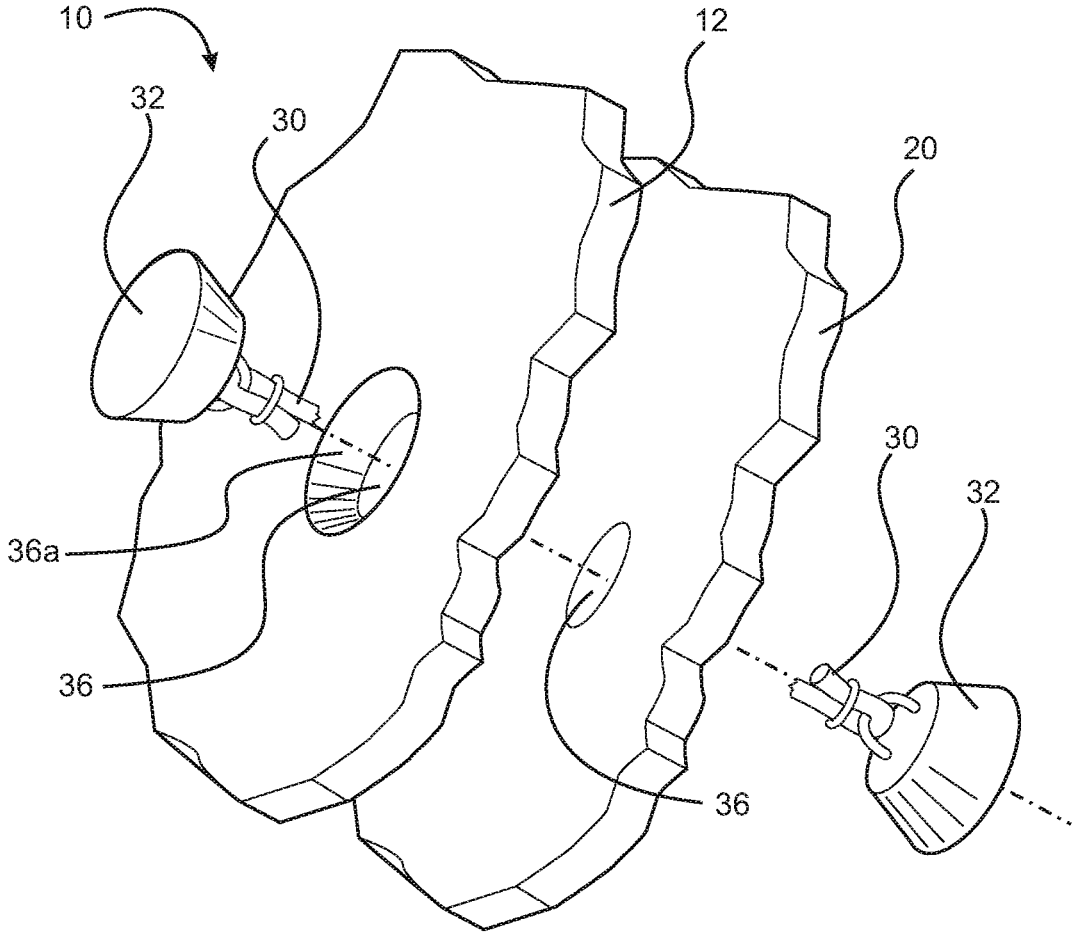
FIG. 6A is an exploded view showing the attachment of the cord to both the inner shell and outer shell to enable the outer shell to float around the inner shell.

FIG. 6A is an exploded view showing one method of attaching cord 30 to helmet 10, such that outer shell 12 floats over inner shell 20. Cavities 36 (or cavity 36), preferably comprising concave sides 36*a*, are drilled or otherwise arranged in outer shell 12 and inner shell 20 such that they are aligned. Each end of cord 30 is attached to plugs 32 which are arranged in the aligned cavities 36. In one embodiment, plugs 32 are secured in cavities 36 using a suitable adhesive known to those having ordinary skill in the art. In an alternate embodiment, plugs 32 are secured in cavities 36 with an interference fit (i.e., press fit or friction fit) or a snap fit.

Figure 6B:
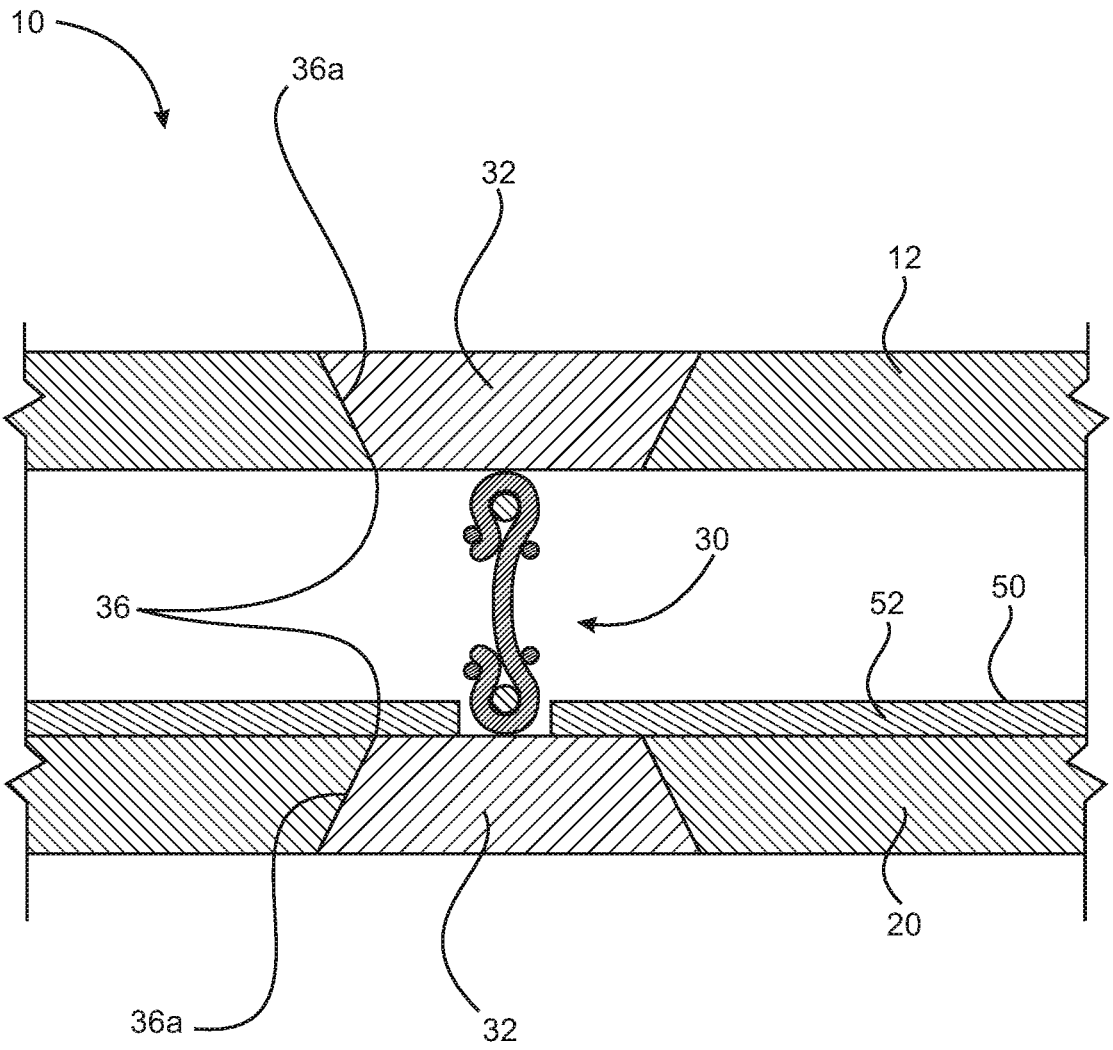
FIG. 6B is a cross-sectional view of the completed attachment fitting with the elastomeric cord attached to two plugs and extending between the outer shell and the inner shell of the helmet.

FIG. 6B is a cross-section of helmet 10 with plugs 32 secured in cavities 36. Cord 30 is attached to two plugs 32 at either end and extends between outer shell 12 and inner shell 20. Also shown is intermediate shell 50 enclosing filler 52. Not shown are bladders 40, which would be arranged between intermediate shell 50 and outer shell 12. Persons of ordinary skill in the art will recognize that cords 31 may be attached between outer shell 12 and inner shell 20 in a similar manner.

Figure 7:
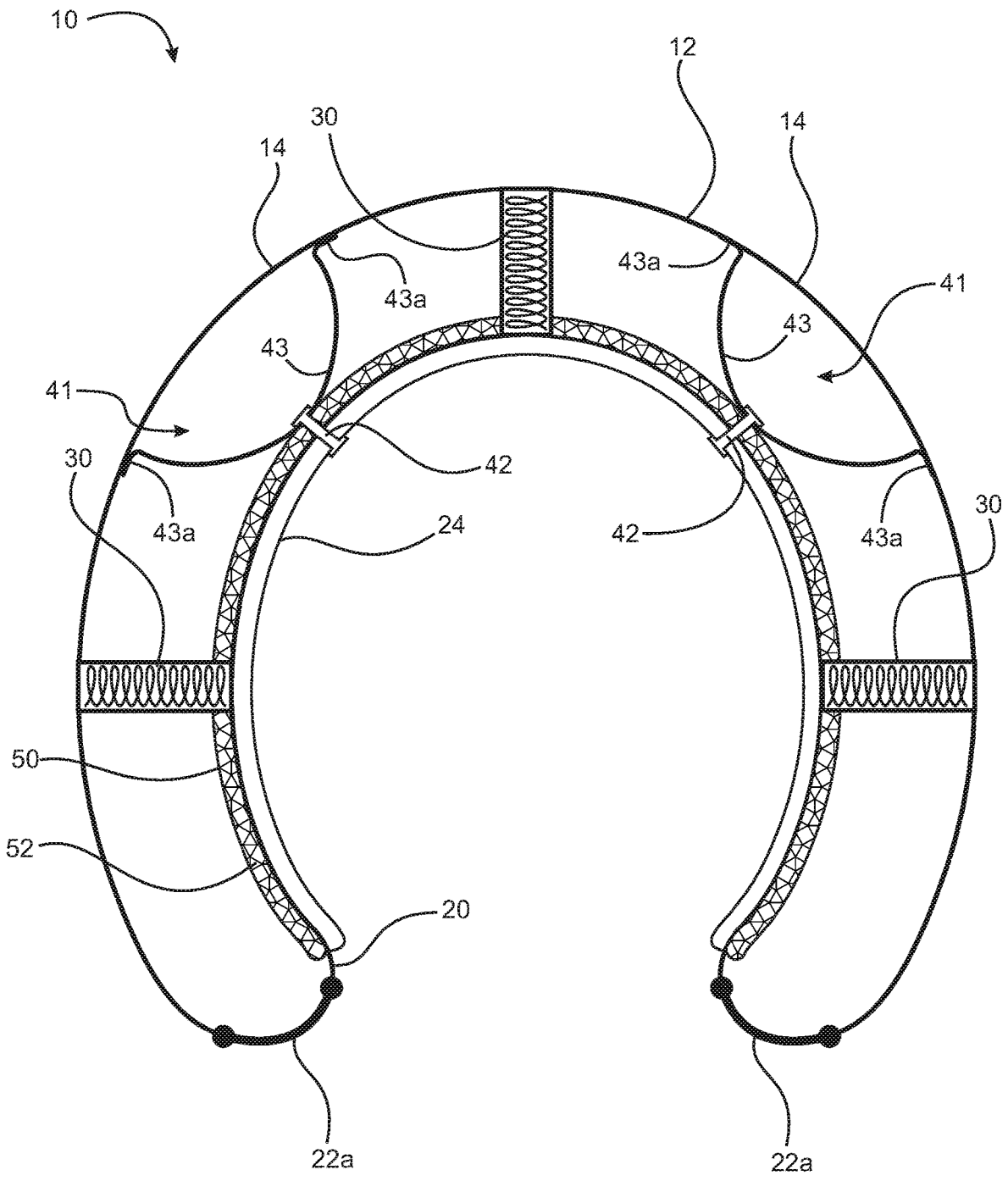
FIG. 7 is a cross-sectional view of an alternate embodiment of the helmet including parabolic leaf springs.
Figure 7A:
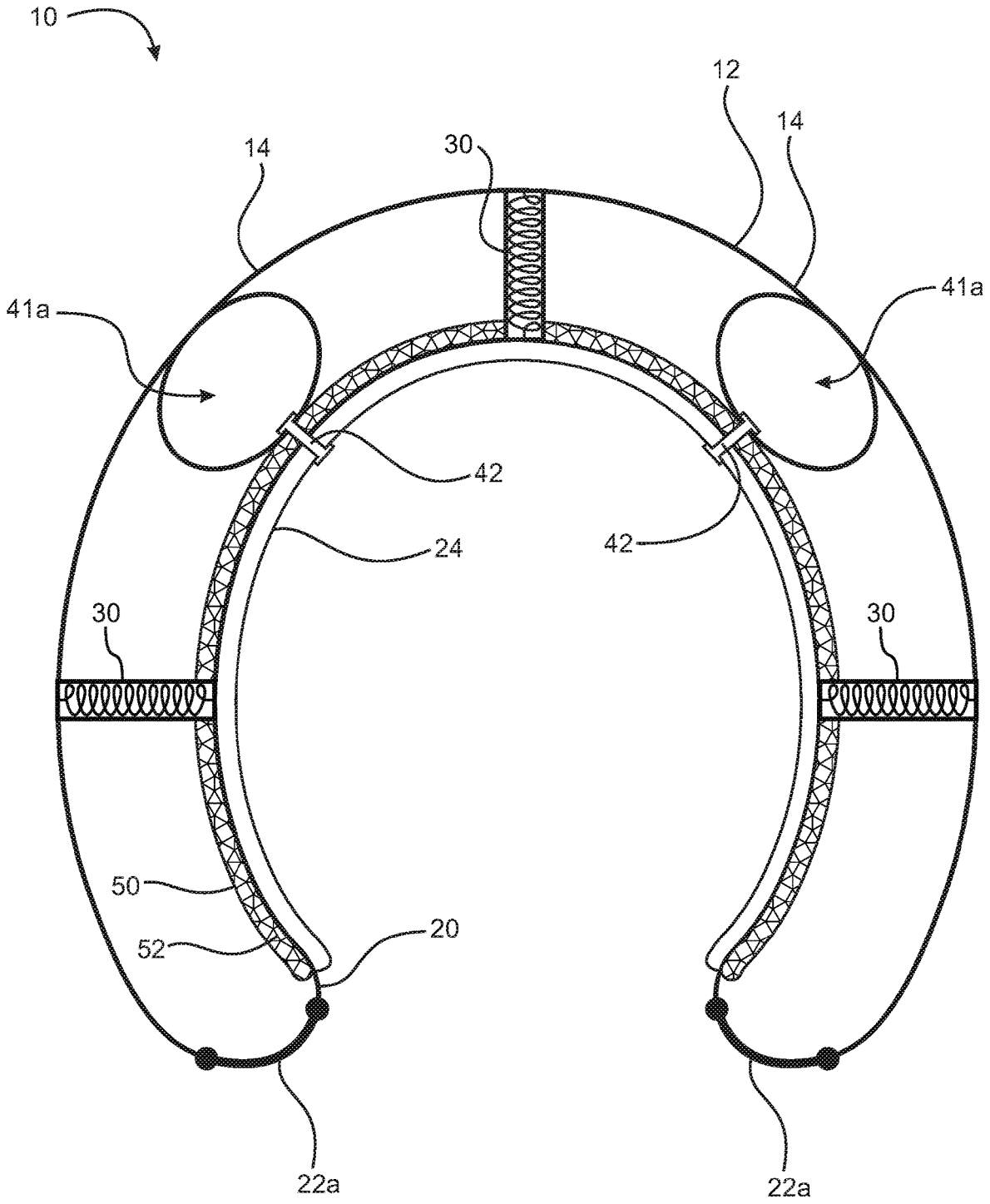
FIG. 7A is a cross-sectional view of an alternate embodiment of the helmet including elliptical leaf springs.

FIG. 7 is a cross-sectional view of an alternate embodiment of helmet 10 wherein bladders 40 are replaced with force absorbers/deflectors comprising parabolic leaf springs 41 (or springs 41). In the embodiment shown, springs 41 are fixedly secured to inner shell 20 at anchor points 42 (or anchor point 42). Each of springs 41 comprise at least one arm 43 (or arms 43) with two ends 43*a*, which are preferably curvedly shaped as shown. Arms 43 are preferably tapered having a thicker center portion near anchor point 42 and gradually thinning in width and/or thickness towards ends 43*a*. In addition, arms 43 may be laminated with gradually fewer applied elastic layers as distance from anchor point 42 increases. A plurality of arms 43 may be arrayed radially around, and attached to, a single anchor point 42. As shown in FIG. 7, arms 43 extend to crumple zone or intermediate shell 50, if present, and anchor points 42 extend through crumple zone 50. Leaf springs 41 may also be used in conjunction with elastomeric cords 30. FIG. 7A is an alternate embodiment comprising elliptical leaf springs 41*a* (or spring 41*a*) instead of parabolic leaf springs 41. Like springs 41, each of springs 41*a* is attached at single anchor points 42.

Figure 8:
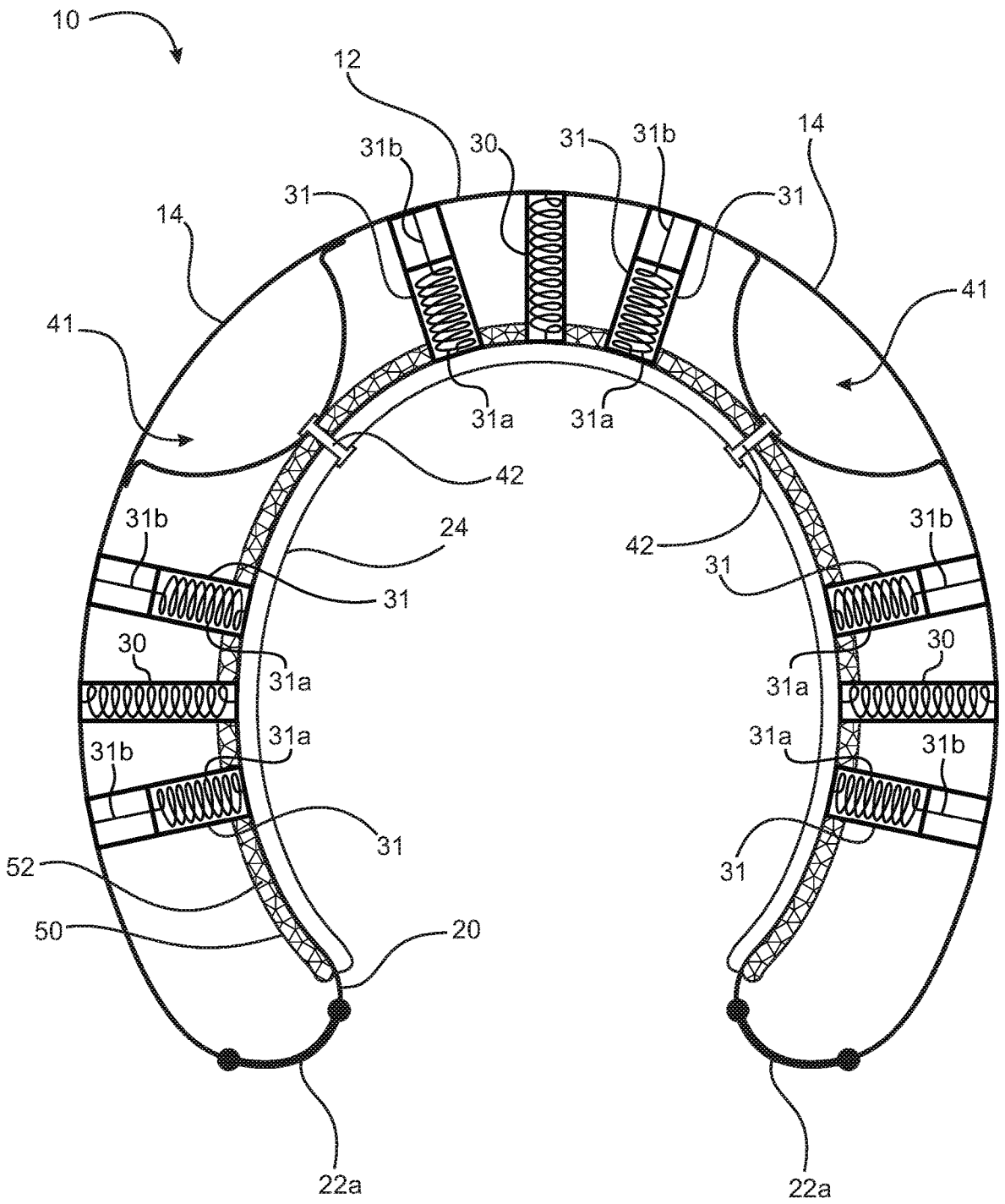
FIG. 8 is a cross-sectional view of the alternate embodiment of the protective helmet shown in FIG. 7 showing the leaf springs with elastomeric cords.

FIG. 8 is a cross-section of the embodiment of helmet 10 shown in FIG. 7, wherein leaf springs 41 are used in conjunction with both elastomeric cords 30 and cords 31. As described above, cords 31 act as a backup to prevent cords 30 from being stretched beyond their elastic limit. Elastomeric portions 31*a* of cords 31 comprise a diameter larger than the diameter of uniform elastomeric cords 30. As shown in FIG. 8, the thick portions may be attached to either outer shell 12 or inner shell 20.

Figure 9:
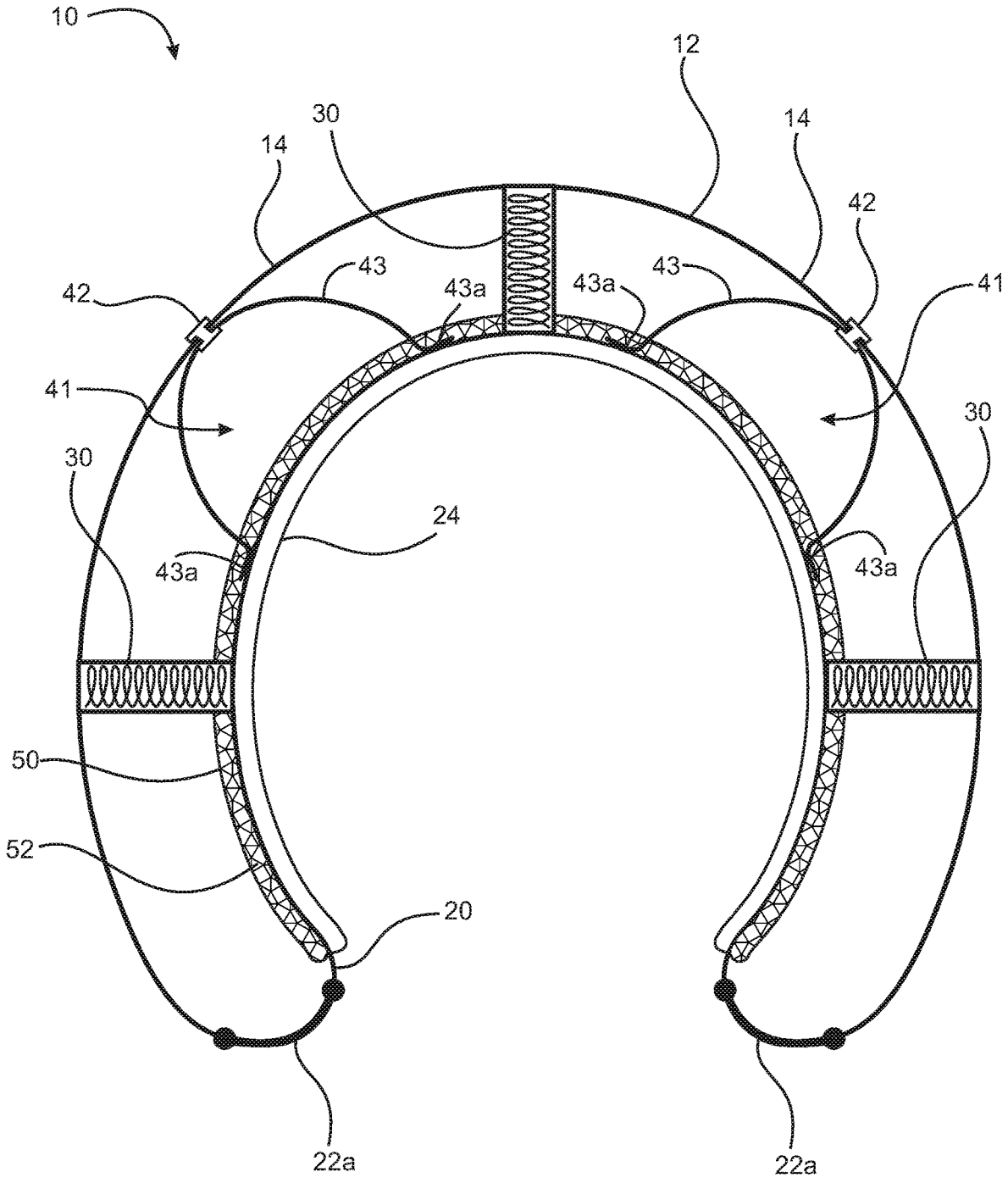
FIG. 9 is a cross-sectional view of the helmet illustrating leaf springs anchored on the outer shell of the helmet.

FIG. 9 is a cross-sectional view of helmet 10 comprising leaf springs 41, fixedly secured to outer shell 12, as well as cords 30. It should be appreciated that the embodiment of helmet 10 shown may further comprise cords 31 as shown in FIG. 8.

Figure 10A:
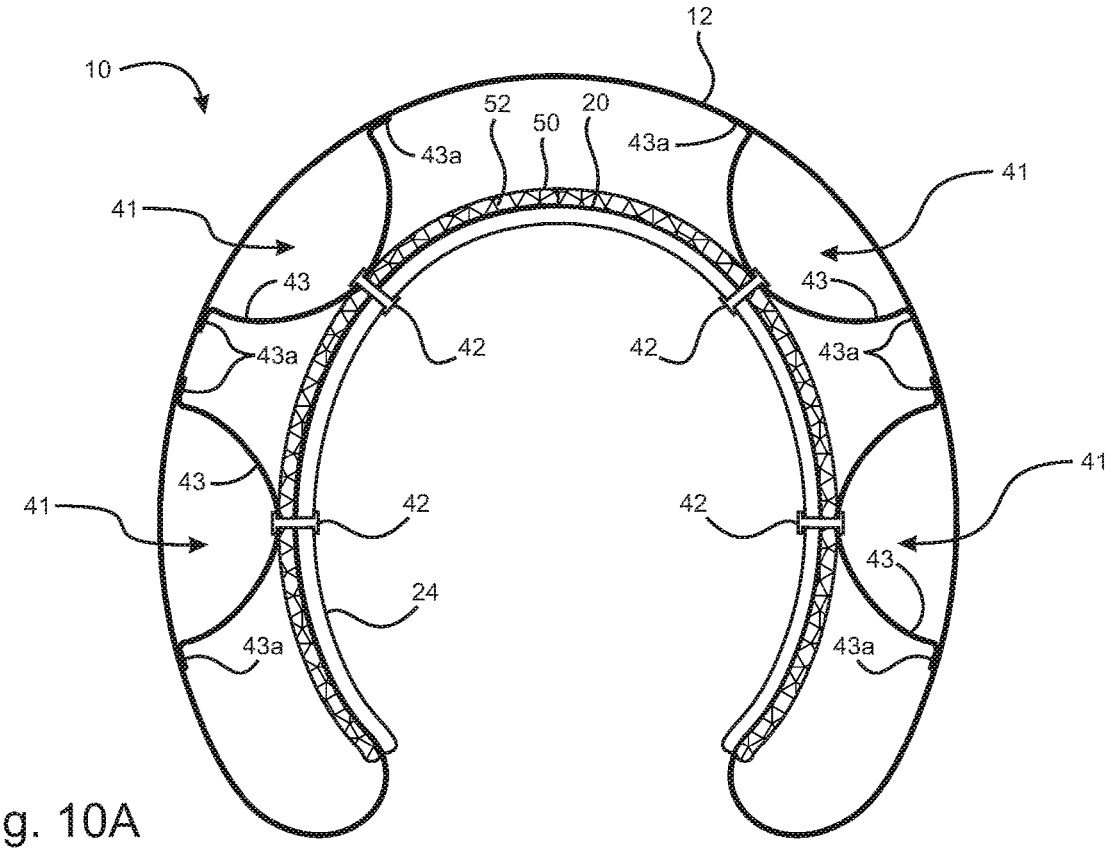
FIG. 10A depicts schematically the parabolic leaf springs when the helmet is in a neutral state before being struck by a force.
Figure 10B:
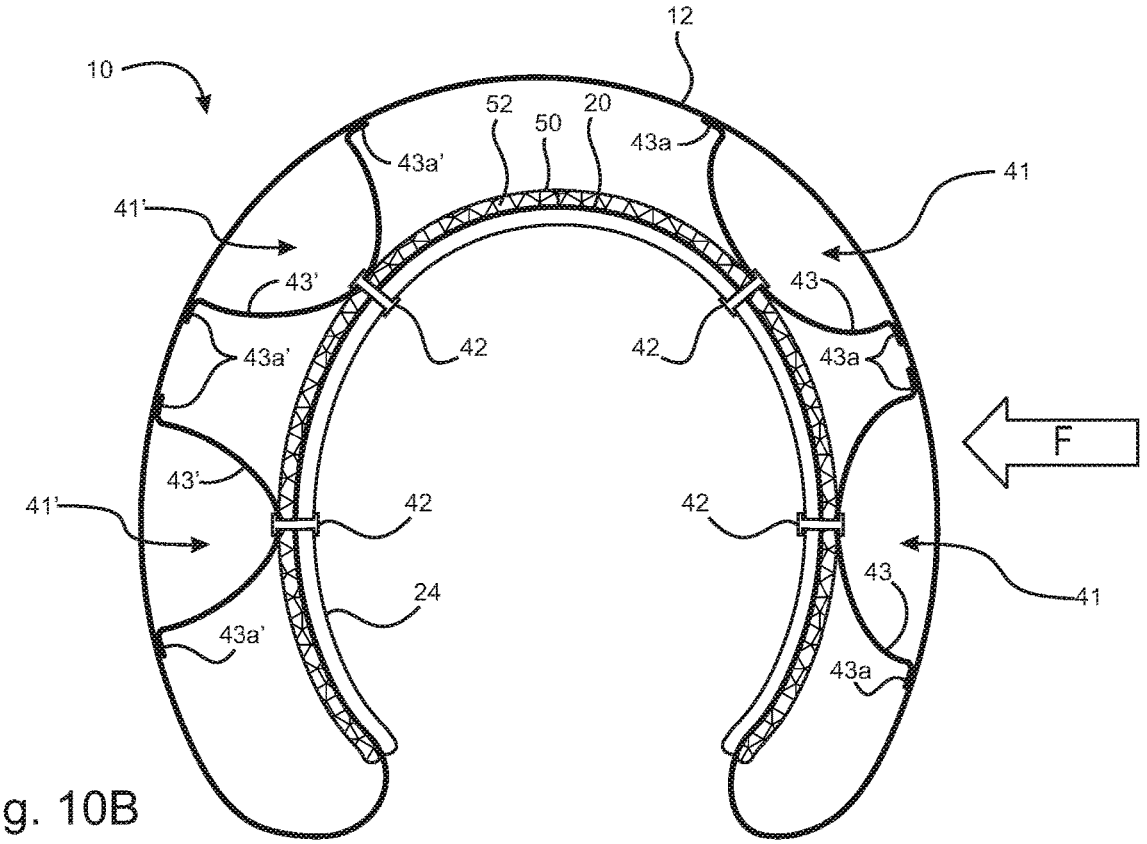
FIG. 10B depicts schematically how the parabolic leaf springs temporarily change their shape when absorbing a force striking the helmet.

FIGS. 10A and 10B schematically depict the action of leaf springs 41 when helmet 10 is struck by a force. In FIG. 10A, helmet 10 is in the neutral state. In the neutral state, springs 41 are under relatively slight tension on all circumferential locations about helmet 10. In FIG. 10B, force F strikes helmet 10, specifically outer shell 12, the right hand side (i.e., radially inward relative to helmet 10). Ends 43*a* are separated further from each other as arms 43 are pushed toward inner shell 20 (i.e., the radial distance between inner shell 20 and outer shell 12 decreases) to absorb the translational force vector created by force F. Simultaneously, ends 43*a*' of arms 43' of springs 41' located on the opposite side of helmet 10 move closer together as the tension on arms 43' is reduced (i.e., the radial distance between inner shell 20 and outer shell 12 increases). After force F is exhausted, the increased tension created on the arms 43 on the right hand or contact side of helmet 10 act to return outer shell 12 radially outward toward the neutral position. The relaxed tension of arms 43' on the noncontact side of helmet 10 allows outer shell 12 to move radially inward, closer to inner shell 20, toward the neutral position. Although not shown in FIGS. 10A and 10B, it will be understood that cords 30 and/or cords 31 will act to absorb any rotational or torsional forces generated on helmet 10 by force F.

Figure 11:
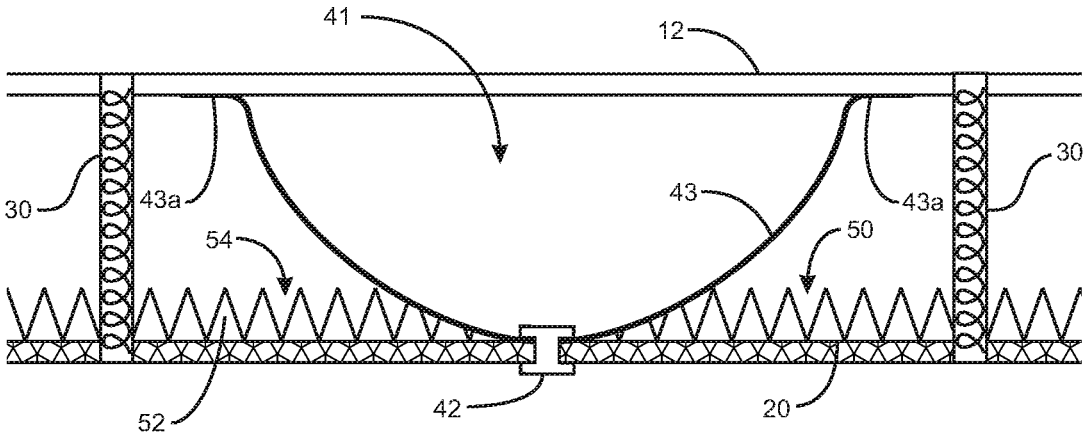
FIG. 11 is an enlarged schematic cross-sectional view of a crumple zone in a helmet in which a leaf spring is the force absorber/deflector.
Figure 12:
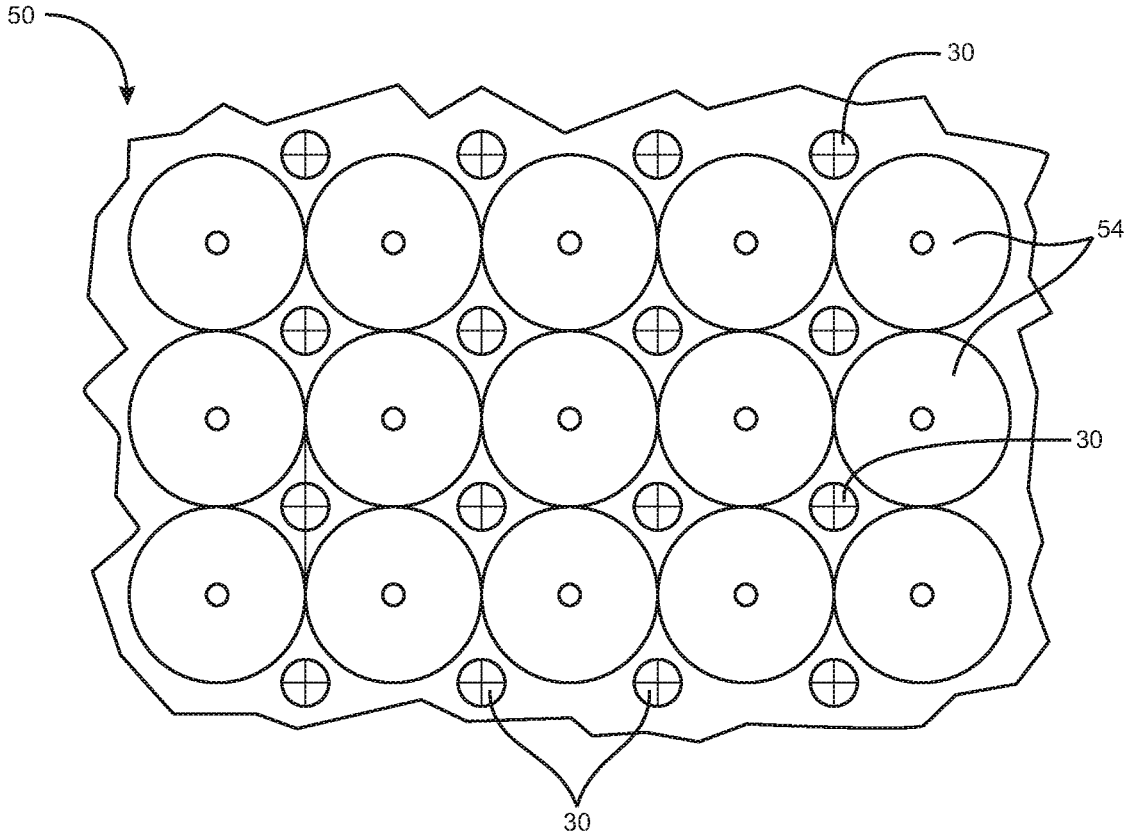
FIG. 12 is a top view of the crumple zone showing a plurality of elastomeric cords extending between the cones of a visco-elastic material.

FIG. 11 is an enlarged schematic cross section of crumple zone or intermediate zone 50 in helmet 10 wherein leaf spring 41 is the force absorber/deflector. Elastomeric cords 30 extend from inner shell 20 to outer shell 12. Crumple zone 50 is arranged circumferentially between cords 30 and comprises filler 52. In the embodiment shown, filler 52 material is in the shape of a plurality of cones 54. In an example embodiment, filler 52 comprises viscoelastic materials, such as, SORBOTHANE® material, or a combination of viscoelastic materials. Viscoelastic materials provide the advantage of behaving like a quasi-liquid, being readily deformed by an applied force and recovering slowly, although, in the absence of such a force, it takes up a defined shape and volume. An unusually high amount of the energy from an object dropped onto SORBOTHANE® material is absorbed. Leaf spring 41 pivotably connected to inner shell 20 by anchor point 42, extends up through crumple zone 50, and contacts outer shell 12. In this embodiment, cones 54 in crumple zone 50 act to absorb a blow having much greater than normal force so that springs 41 are deflected to such a degree that outer shell 12 reaches crumple zone 50. FIG. 12 is a top view of crumple zone 50 showing a plurality of cords 30 arranged between cones 54 comprising viscoelastic material. It should be appreciated that a helmet employing fluid-filled bladders may include a crumple zone having viscoelastic materials as a filler such as SORBOTHANE® material or STYROFOAM® peanuts.

Figure 13A:
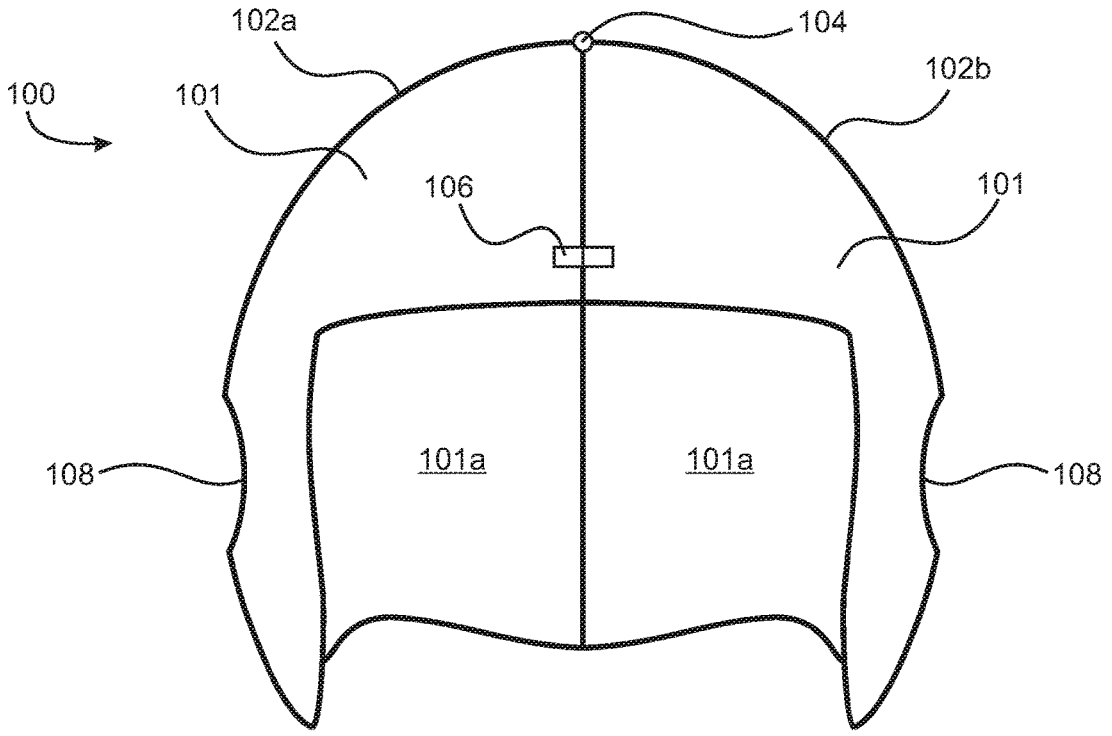
FIG. 13A is a front view of an articulating helmet, which is divided into at least two parts that are attached by an articulating means such as hinges or pivots.
Figure 13B:
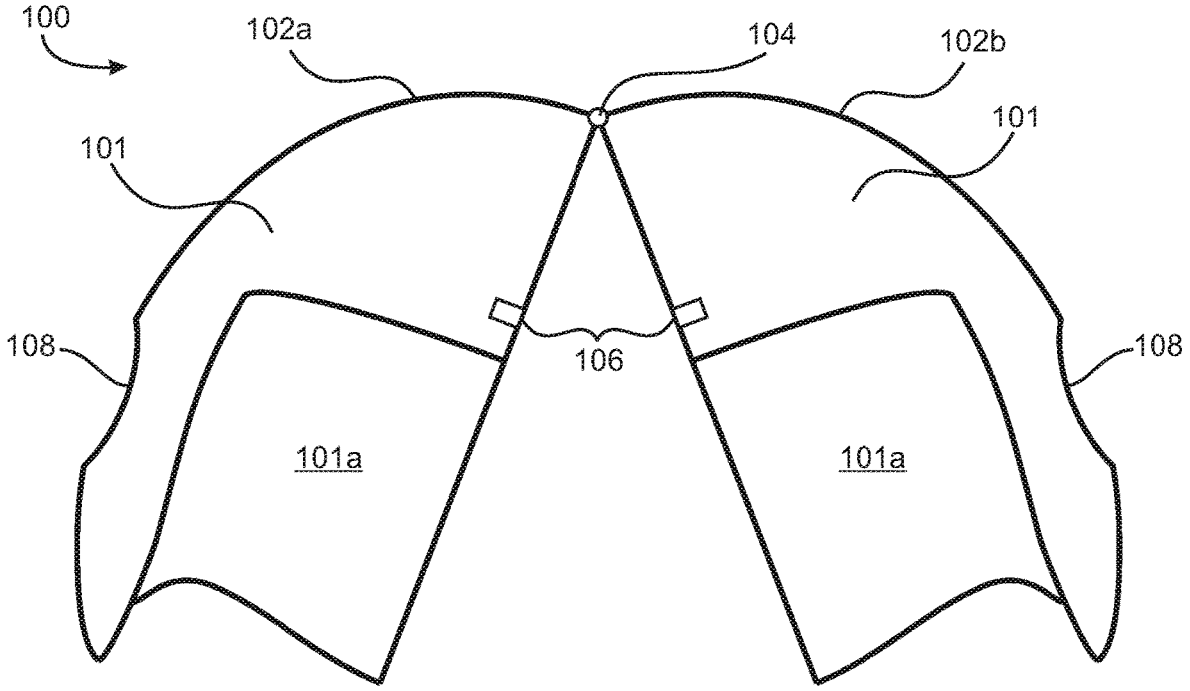
FIG. 13B is a front view of an articulating helmet, which is divided into two parts.

FIGS. 13A and 13B are front views of articulating helmet 100 ("helmet 100"), which is divided into at least two parts that are attached by an articulating means. By articulating, it is meant that the helmet comprises parts or sections joined by an articulating means such as hinge or pivot connections, swivels, or other devices that allow the separate parts of the helmet to be opened and closed together. Each section includes hard outer shell 101. FIG. 13A shows helmet 100 in the closed and locked orientation. Sections 102*a* and 102*b* are connected through articulating means 104. In this embodiment, articulating means 104 is a hinge. It should be appreciated that any number of articulating means 104 suitable to open and close helmet 100 may be used, and that the invention is not limited to the use of one articulating means. Preferably, helmet 100 comprises one or more locks 106 (or lock 106) to secure helmet 100 in the closed position. Helmet 100 further comprises ear apertures 108 and inner surface 101*a*. FIG. 13B shows helmet 100 in the open orientation. Lock 106 is disengaged allowing articulating means 104 to open and separate sections 102*a* and 102*b*.

Figure 14A:
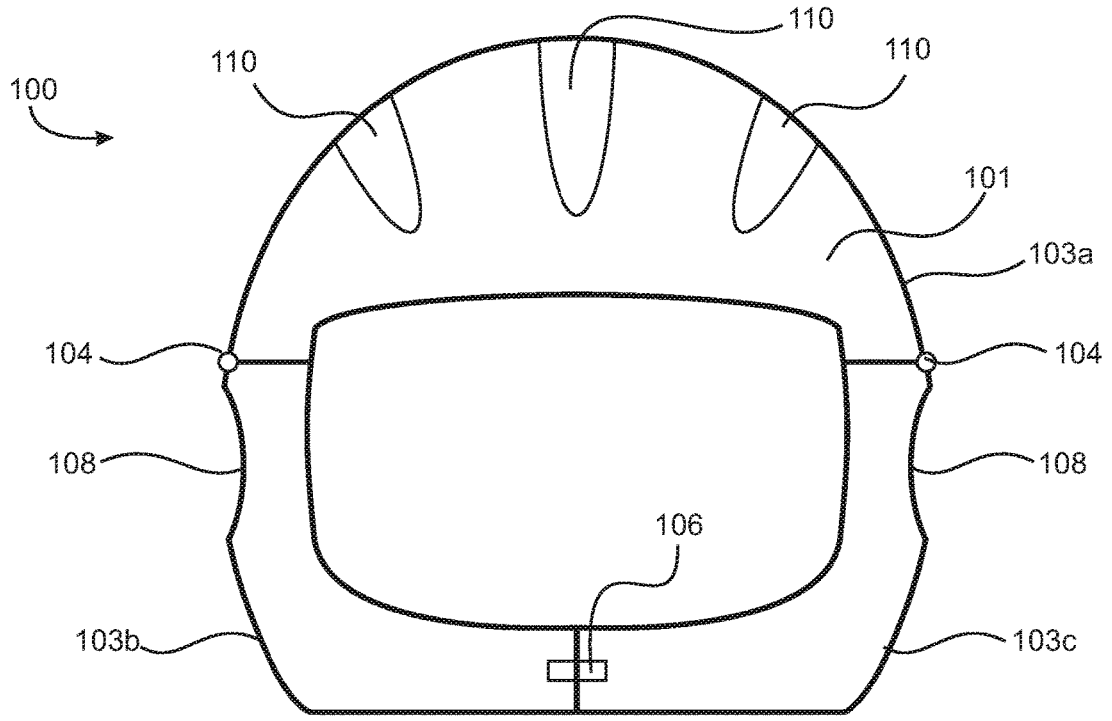
FIG. 14A is a front view of an alternate embodiment of the articulating helmet having three articulating sections.
Figure 14B:
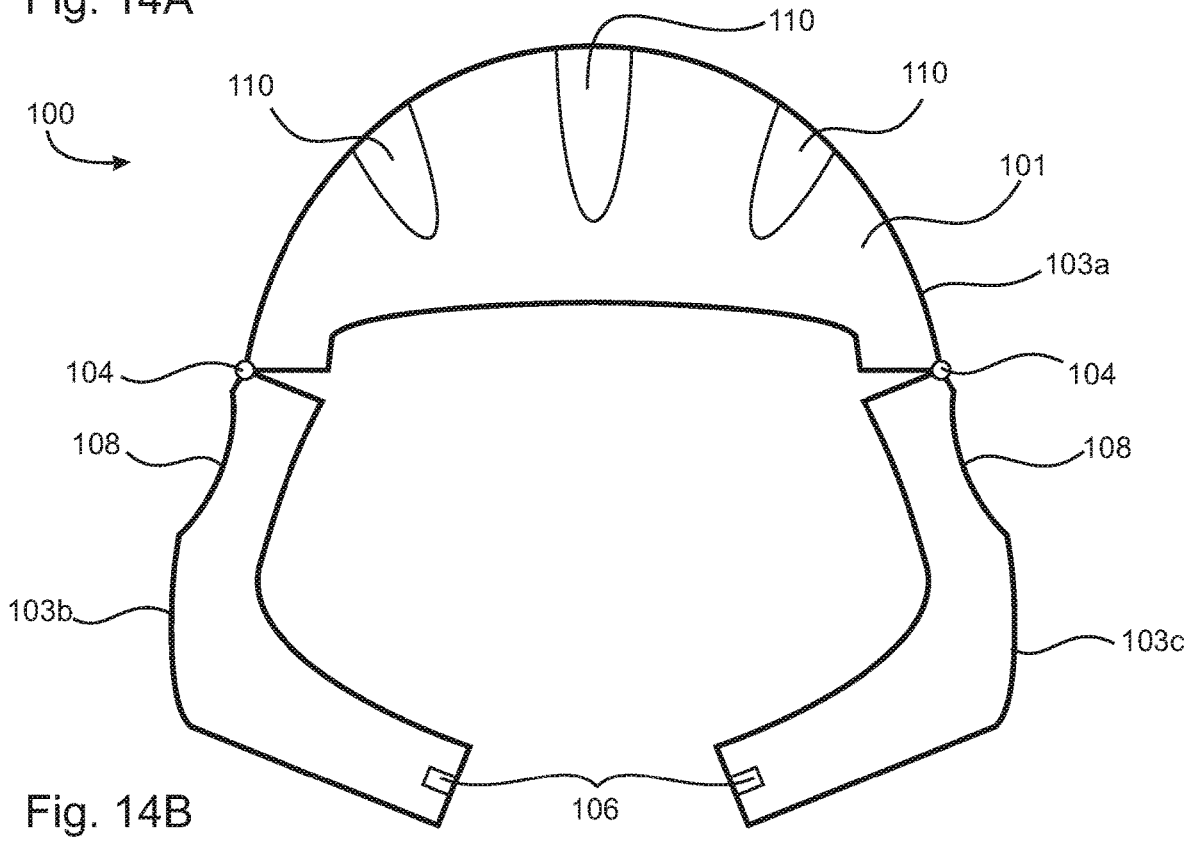
FIG. 14B is a front view of the articulating helmet of FIG. 14A.
Figure 15:
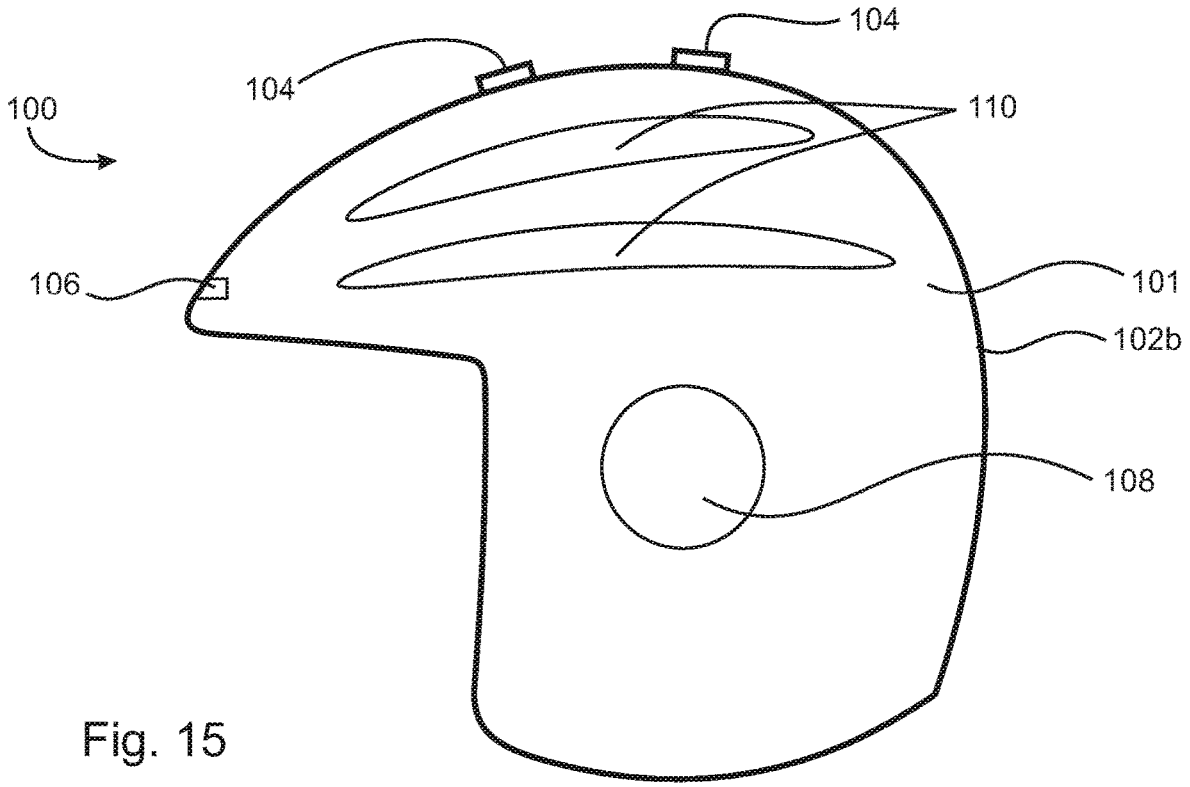
FIG. 15 is a side view of a two-section embodiment of an articulating helmet including air vents.
Figure 16:
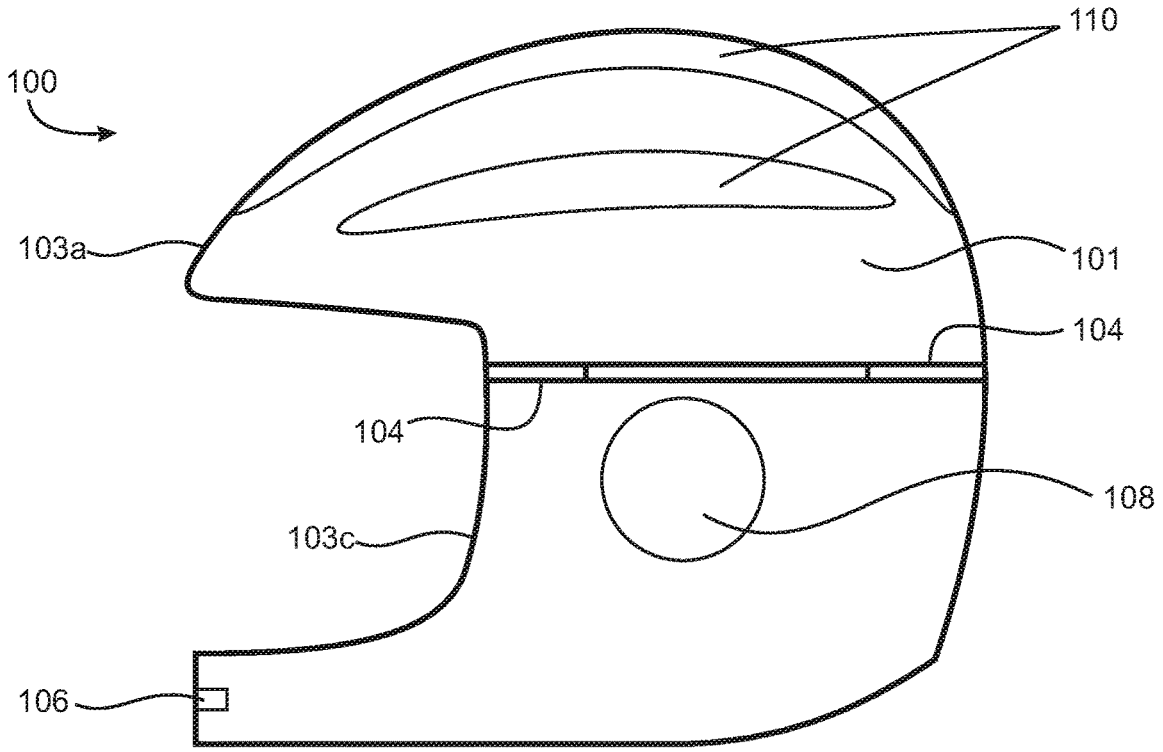
FIG. 16 is a side view of a three-section embodiment of an articulating helmet showing two hinges for the articulating means.

FIGS. 14A and 14B depict front views of an alternate embodiment of helmet 100 comprising sections 103*a*, 103*b*, and 103*c*. In this embodiment, helmet 100 includes air vents 110, which are openings defined by helmet 100 that extend from outer surface 101 through to inner surface 101*a*. Articulating means 104 allows sections 103*b* and 103*c* to pivot with respect to section 103*a*. One or more locks 106 hold sections 103*b* and 103*c* in the closed position. It should be appreciated that air vents 110 may be arranged in helmets having any number of sections, for example, a helmet having two sections (as shown in FIGS. 13A and 13B). FIG. 14B shows helmet 100 in the open position in which both articulating means 104 open to separate sections 103*b* and 103*c* from section 103*a*. FIG. 15 is a side view of the two-section embodiment of helmet 100, as shown in FIGS. 13A and 13B, further comprising air vents 110 and two articulating means 104. Similarly, FIG. 16 is a side view of the three-section embodiment of helmet 100, as shown in FIGS. 14A and 14B, showing two articulating means 104 for section 103*c*.

Figure 17:
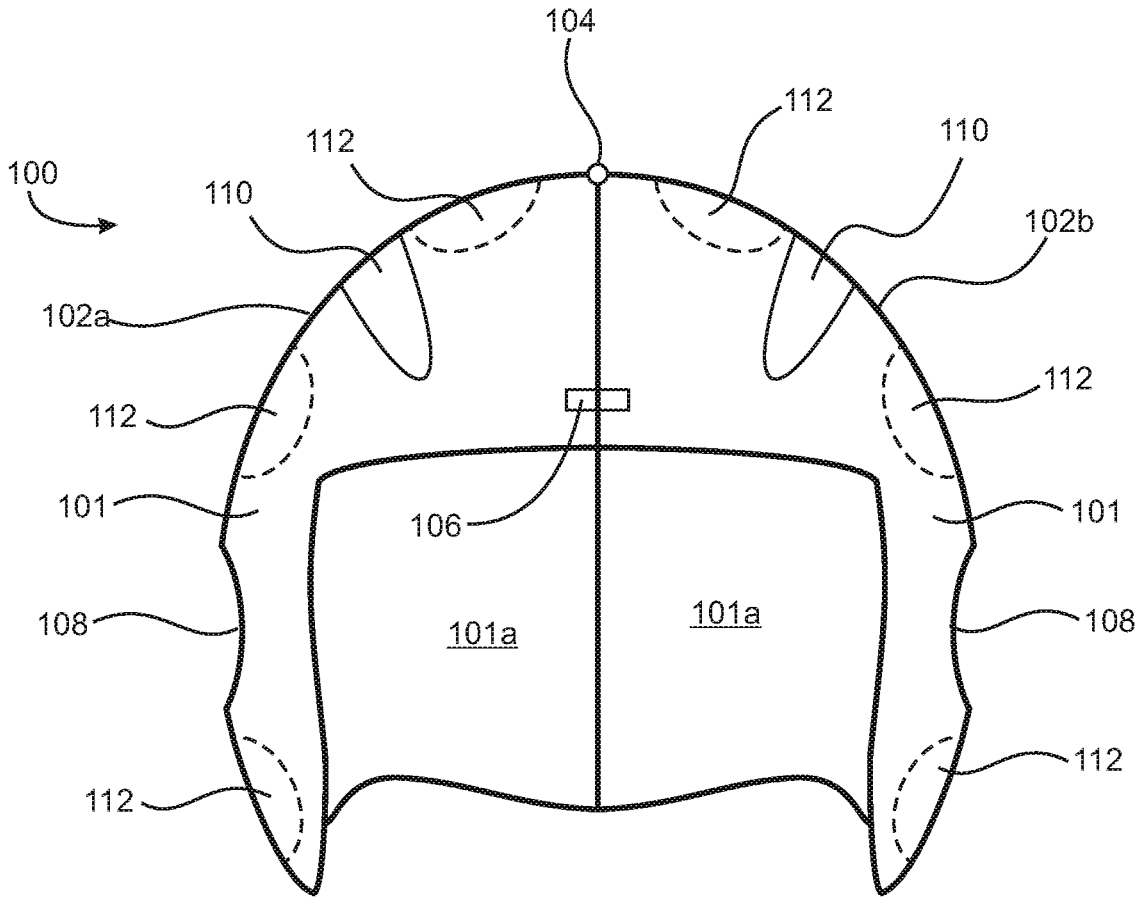
FIG. 17 is a front view of an additional alternate embodiment of an articulating helmet including pads or cushions attached to the inner surface of the helmet.

FIG. 17 is a front view of another alternate embodiment of articulating helmet 100 wherein pads or cushions 112 are attached to inner surface 101*a* of helmet 100. Pads 112 may be permanently attached to inner surface 101*a* with suitable attachment devices such as rivets, screws, or adhesives. Alternatively, pads 112 may be releasably attached to inner surface 101*a* using attachment devices such as VELCRO® hook and loop material, suction cups, snap buttons, or other releasable coupling device. Releasably attached pads 112 provides the advantage of allowing a user to customize helmet 100 with cushions 112 of various sizes, materials, and arrangements that provide a snug fit when helmet 110 is worn. Pads 112 comprise any suitable foam materials known to those having ordinary skill in the art. In both embodiments, pads 112 are attached to inner surface 101*a* between vents 110 to ensure maximum air flow to the user.

Figure 17A:
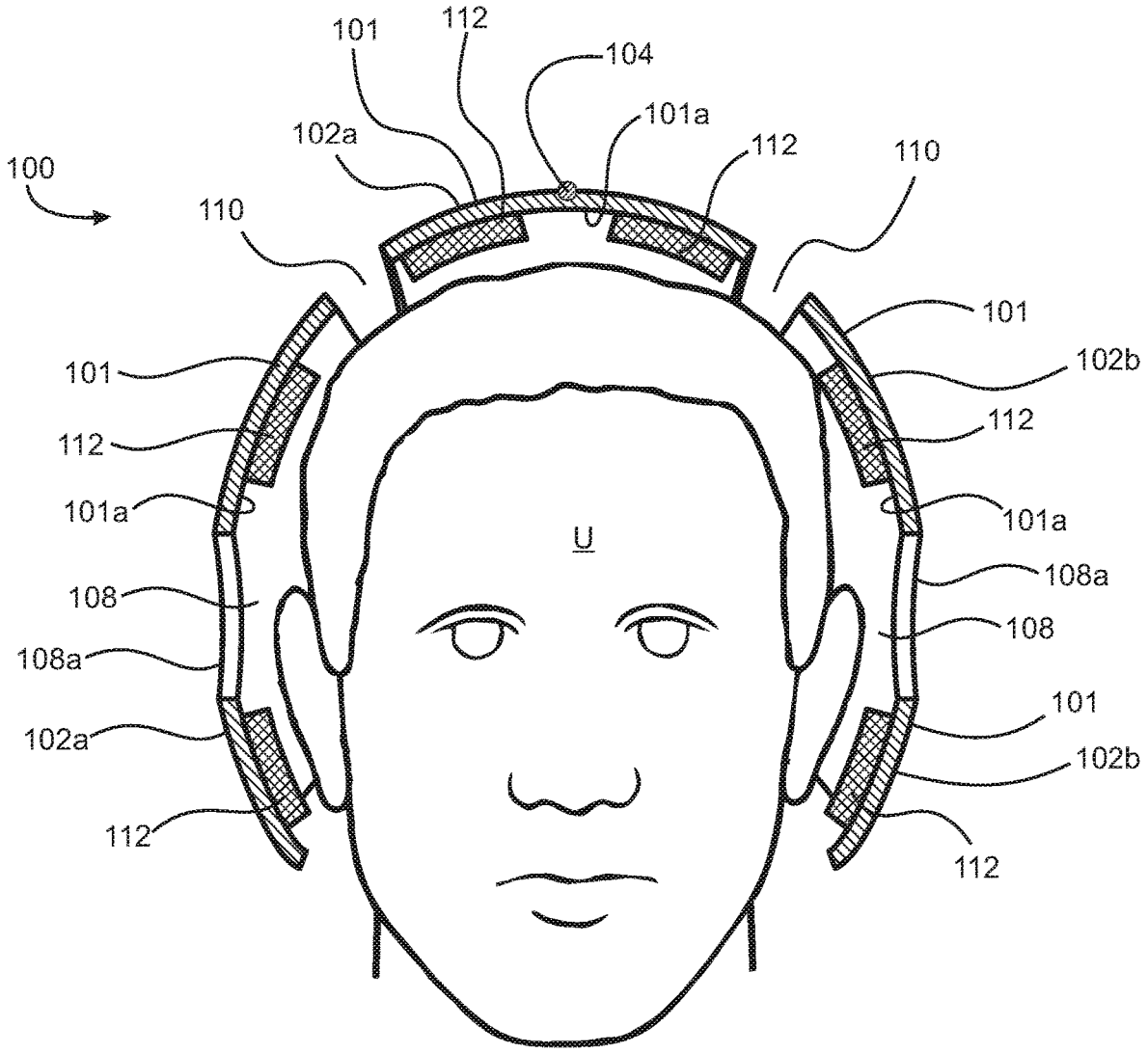
FIG. 17A is a front view of a user wearing an articulating helmet in a cross-sectional view demonstrating the fit of the helmet on the user.

FIG. 17A is a front view of a user showing a cross-section of articulating helmet 100 as worn by user U, with outer shell 120 removed. When helmet 100 is worn, pads 112 contact the top of the head of user U to provide a snug fit. It should be appreciated that pads 112 are arranged on inner surface 101*a* such that air vents 110 are unimpeded and provide air flow to user U. In this embodiment, ear apertures 108 are covered with a membrane or diaphragm 108*a*. In one embodiment, diaphragm 108*a* is fabricated from KEVLAR® fabric.

Figure 18:
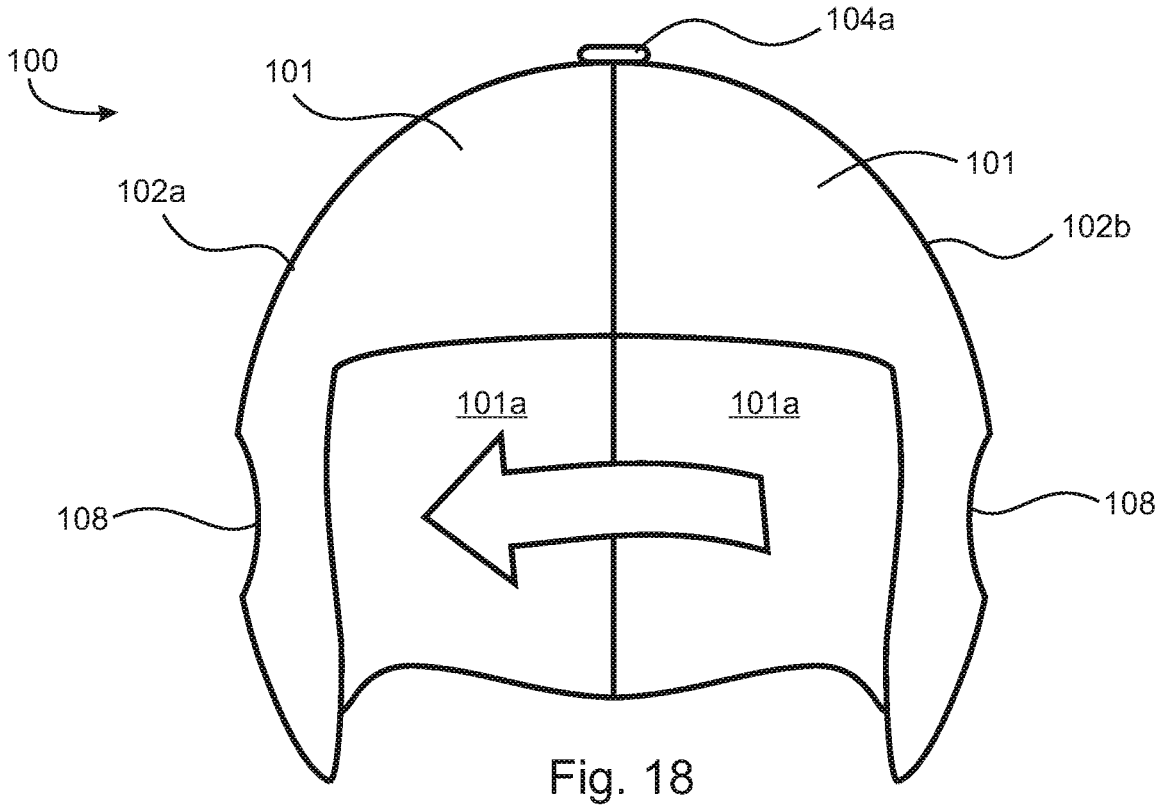
FIG. 18 is a front view of an articulating helmet.
Figure 18A:
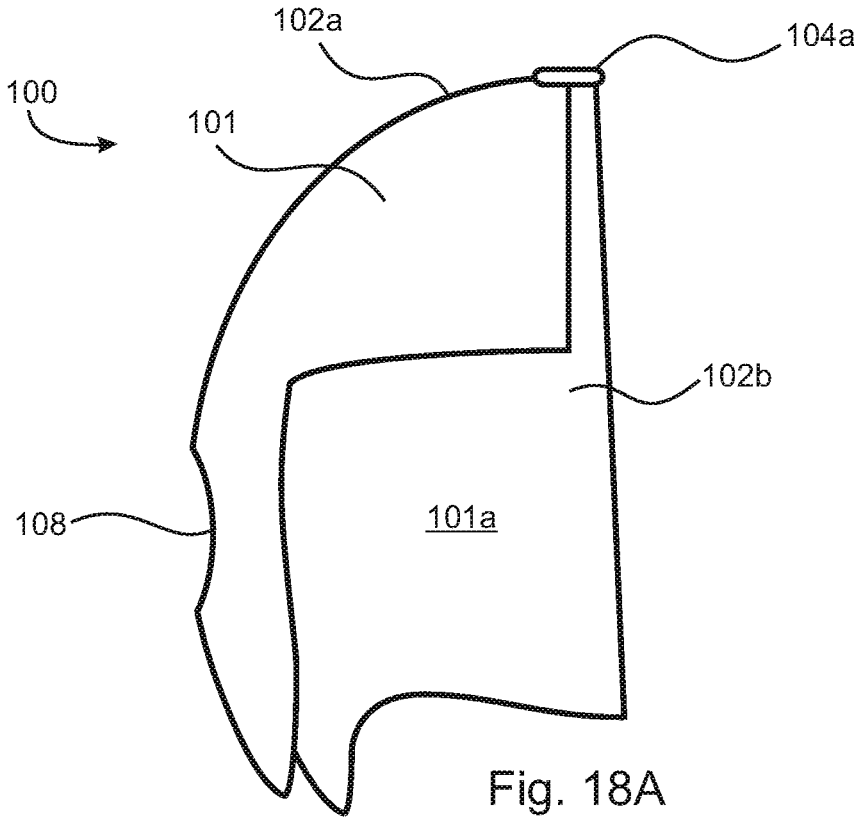
FIG. 18A is a front view of the articulating helmet of FIG. 18.

FIGS. 18 and 18A are front views of articulating helmet 100 showing an embodiment wherein one section of helmet 100 may nest inside the other. In FIG. 18A, section 102*b* is nested inside section 102*a* and helmet 100 is in the open position. Articulating means 104*a* is a swivel operatively arranged to hold sections 102*a* and 102*b* together and allow sections 102*a* and 102*b* to open and turn relative to each other such that outer surface 101 of one section radially faces inner surface 101*a* of the other section. For example, section 102*b* is rotated 90 degrees radially inside of section 102*a*, or vice versa. This embodiment decreases the overall volume of helmet 100 in the open position making it easier to store.

Figure 19A:
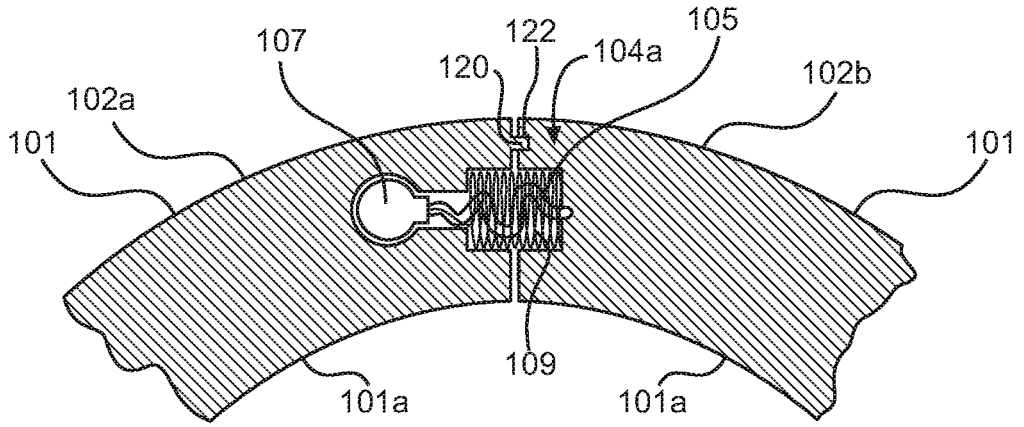
FIG. 19A depicts an enlarged cross-sectional view of a swivel that enables two articulating sections of an articulating helmet to nest within one another.
Figure 19B:
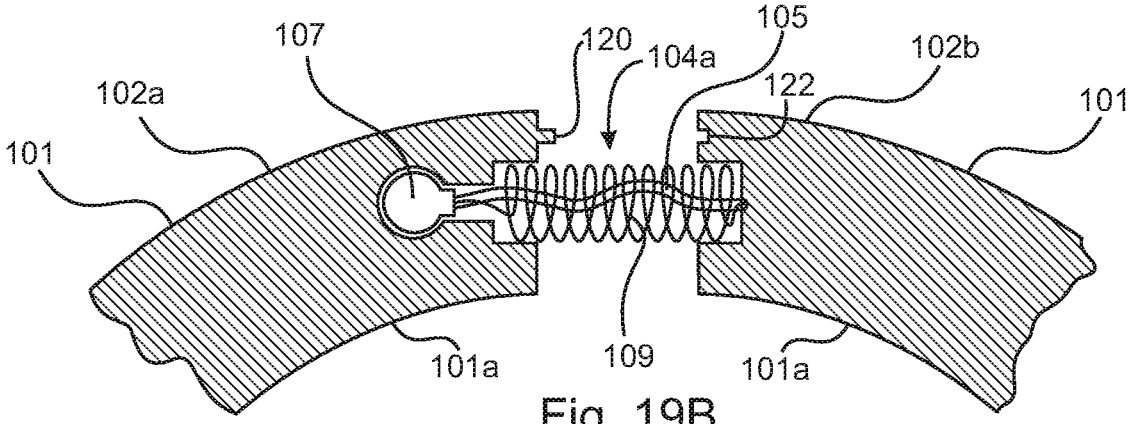
FIG. 19B depicts an enlarged cross-sectional view showing two articulating sections of an articulating helmet pulled apart prior to being placed into a nesting position; and, FIG. 19C depicts an enlarged cross-sectional view of two articulating sections in a nested position.
Figure 19C:
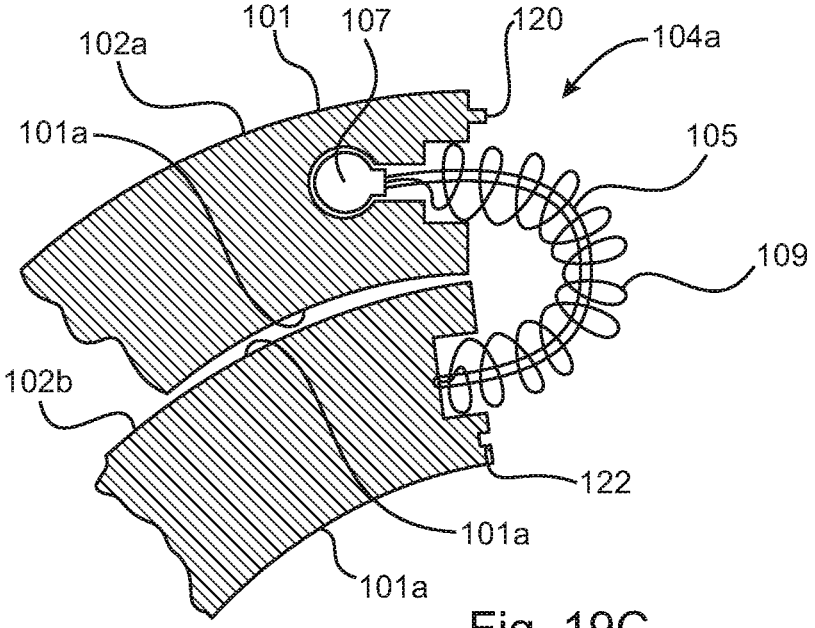

FIG. 19A depicts an enlarged cross-sectional view of one embodiment of swivel means 104*a* that enables sections 102*a* and 102*b* to turn and nest within one another. Cable 105 is attached to section 102*b* at one end and universal joint 107 at another end. Spring 109 is connected to universal joint 107 at a first end and section 102*b* at a second end. Universal joint 107 is rotatably connected to section 102*a* (e.g., embedded therein) such that cable 105 and section 102*b* are rotatable relative to section 102*a*, and vice versa. Spring 109 pulls attached section 102*b* (and cable 105) toward section 102*a*. FIG. 19B shows sections 102*a* and 102*b* pulled apart with stretched spring 105 holding the two sections together. In addition, male prongs or tubes 120 can be arranged on section 102*a* which slide into ports 122 arranged on section 102*b* to stabilize the helmet when sections 102*a* and 102*b* are joined together. Alternatively, male prongs or tubes 120 can be arranged on section 102*b* and ports 122 can be arranged on to section 102*a* (this embodiment is not shown). As shown in FIG. 19C, universal joint 107 enables section 102*b* to rotate relative to section 102*a* after which section 102*b* is pulled back toward section 102*a*. Because section 102*b* has been rotated, outer surface 101 of section 102*b* nests against inner surface 101*a* of section 102*a*.

It will be appreciated that various aspects of the disclosure above and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A protective helmet, comprising:

an outer shell;

an inner shell slidingly connected to the outer shell; and, a leaf spring comprising a center portion, a first end, and a second end, the leaf spring anchored only at the center portion to the outer shell, the first end unattached to, and in direct sliding contact with, the inner shell, and the second end unattached to, and in direct sliding contact with, the inner shell;

wherein:

in a neutral position, the first end is spaced from the second end by a first distance; and, when a force strikes the helmet, the first end is spaced from the second end by a second distance, the second distance being different from the first distance.

2. The protective helmet as recited in claim 1, wherein the first end includes a first arm arrayed radially around the anchored center portion and the first arm is arranged to slide along the outer surface of the inner shell.

3. The protective helmet as recited in claim 2, wherein the second end includes a second arm arrayed radially around the anchored center portion and the second arm is arranged to slide along the outer surface of the inner shell.

4. The protective helmet as recited in claim 1, wherein the leaf spring is parabolic in shape.

5. The protective helmet as recited in claim 1, further comprising an elastomeric cord extending between and connecting the outer shell and the inner shell.

6. The protective helmet as recited in claim 5, wherein the elastomeric cord is uniform in thickness.

7. The protective helmet as recited in claim 5, wherein the elastomeric cord passes through an intermediate shell.

8. The protective helmet as recited in claim 5, wherein the elastomeric cord includes a thick portion and a thin portion.

9. The protective helmet as recited in claim 8, wherein the thick portion is connected to the inner shell and the thin portion is connected to the outer shell.

10. The protective helmet as recited in claim 1, further comprising viscoelastic material arranged between the outer shell and the inner shell.

11. The protective helmet as recited in claim 10, wherein the viscoelastic material is made of a plurality of cone-shaped elements.

12. The protective helmet as recited in claim 1, wherein the inner and outer shells comprise hard materials.

13. The protective helmet as recited in claim 1, further comprising an intermediate shell arranged proximate the inner shell.

14. The protective helmet as recited in claim 13, wherein the intermediate shell comprises a filler.

15. A protective helmet, comprising:

a hard outer shell;

a hard inner shell slidingly connected to, and spaced apart from, the hard outer shell; and, a leaf spring comprising:

a center portion, the leaf spring anchored only at the center portion to the hard outer shell;

a first end unattached to, and in direct sliding contact with, the hard inner shell; and, a second end, unattached to, and in direct sliding contact with, the hard inner shell;

wherein:

in a neutral position, the first end is spaced from the second end by a first distance; and, when a force strikes the helmet, the first end is spaced from the second end by a second distance, the second distance being different from the first distance.

16. The protective helmet as recited in claim 15, wherein the first end includes a first arm arrayed radially around the anchored center portion and the first arm is arranged to slide along the outer surface of the inner shell.

17. The protective helmet as recited in claim 16, wherein the second end includes a second arm arrayed radially around the anchored center portion and the second arm is arranged to slide along the outer surface of the inner shell.

18. The protective helmet as recited in claim 15, further comprising an elastomeric cord extending between and connecting the outer shell and the inner shell.

* * * * *